US007543724B2

(12) United States Patent
Brunner et al.

(10) Patent No.: US 7,543,724 B2
(45) Date of Patent: Jun. 9, 2009

(54) DISPENSING SYSTEM WITH A DISPENSING VALVE HAVING A PROJECTING, REDUCED SIZE DISCHARGE END

(75) Inventors: Andrew J. Brunner, Brookfield, WI (US); Alan P. Hickok, Waukesha, WI (US); Kelly A. Smith, East Troy, WI (US); Timothy R. Socier, Essexville, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 349 days.

(21) Appl. No.: 11/471,814

(22) Filed: Jun. 21, 2006

(65) Prior Publication Data

US 2007/0295763 A1 Dec. 27, 2007

(51) Int. Cl.
*B65D 5/72* (2006.01)

(52) U.S. Cl. ..... 222/494; 222/490; 222/498

(58) Field of Classification Search ..... 222/490, 222/491, 494, 498
See application file for complete search history.

(56) References Cited

U.S. PATENT DOCUMENTS 5,033,655 A 7/1991 Brown
5,971,232 A 10/1999 Rohr et al.
6,112,951 A 9/2000 Mueller
6,230,940 B1 5/2001 Manning et al.
6,547,808 B2 4/2003 Tuckey et al.

FOREIGN PATENT DOCUMENTS

JP 43-16514 7/1968
JP 37-999 1/1987

OTHER PUBLICATIONS

English language summary of 43-16514, Jul. 11, 1968, Battle.
U.S. Appl. No. 10/811,180, filed Mar. 26, 2004.

*Primary Examiner*—Kevin P Shaver
*Assistant Examiner*—Melvin A Cartagena
(74) *Attorney, Agent, or Firm*—Wood, Phillips, Katz, Clark & Mortimer

(57) ABSTRACT

A dispensing system includes a body having a base for extending from a container, and a support column projecting from the base. A discharge passage extends through the body and support column. A flexible, pressure-openable dispensing valve has a skirt mounted on the support column and has an outwardly extending, narrowing head defining a dispensing orifice at the distal end. A clamp member fits around the valve skirt and is engaged with the body to hold the body, valve, and clamp member together.

11 Claims, 38 Drawing Sheets

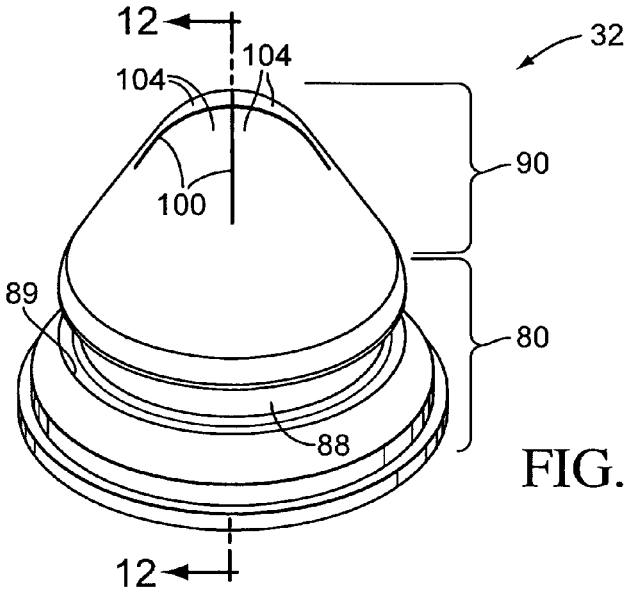
FIG. 11
FIG. 12
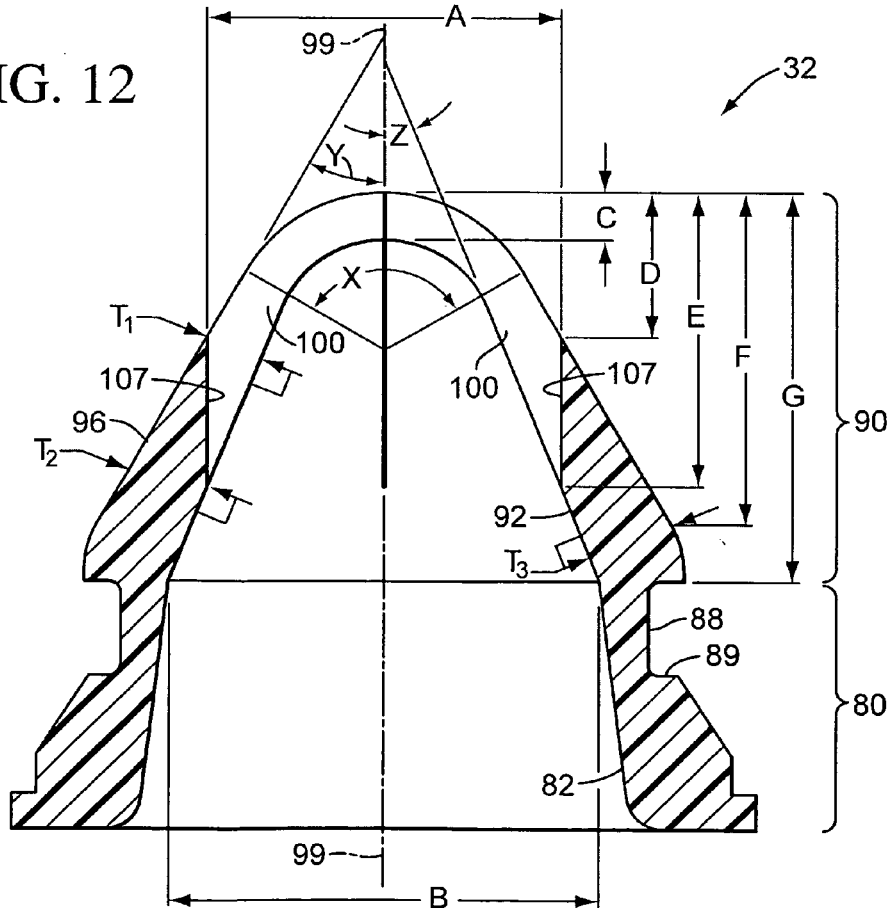

DISPENSING SYSTEM WITH A DISPENSING VALVE HAVING A PROJECTING, REDUCED SIZE DISCHARGE END

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a dispensing system for dispensing a product (e.g., a fluent material) from a container. The invention is particularly suitable for incorporation in a dispensing closure for use with a squeezable container.

BACKGROUND OF THE INVENTION AND TECHNICAL PROBLEMS POSED BY THE PRIOR ART

There are a wide variety of packages which include (1) a container, (2) a dispensing system extending as a unitary part of, or as an attachment to, the container, and (3) a product contained within the container. One type of such a package employs one or more dispensing valves for discharging one or more streams of product (which may be a gas, liquid, cream, powder, or particulate product). See, for example, U.S. Pat. Nos. 5,271,531, 6,112,951, and 6,230,940. The valve is a flexible, resilient, self-sealing, slit-type valve at one end of a bottle or container which typically has resiliently flexible sidewalls which can be squeezed to pressurize the container interior. The valve is normally closed and can withstand the weight of the product when the container is completely inverted, so that the product will not leak out unless the container is squeezed. When the container is squeezed and the interior is subjected to a sufficient increased pressure so that there is a predetermined minimum pressure differential across the valve, the valve opens. Such a valve can be designed so that it can also be opened merely by subjecting the exterior side of the valve to a sufficiently reduced pressure (e.g., as by sucking on the valve).

Such a type of valve can also be designed to stay open, at least until the pressure differential across the valve drops below a predetermined value. Such a valve can be designed to snap closed if the pressure differential across the open valve drops below a predetermined amount. The valve can also be designed to open inwardly to vent air into the container when the pressure within the container is less than the ambient external pressure, and this accommodates the return of the resilient container wall from an inwardly squeezed condition to the normal, unstressed condition.

Such a resilient valve typically includes a central head portion which is recessed inwardly from surrounding portions of the valve which project outwardly. The U.S. Pat. No. 6,230,940 illustrates one form of such a valve mounted in the dispensing opening of a closure body by means of a groove in the valve exterior which receives a mounting flange of the closure.

It would be desirable to provide an improved arrangement for mounting a dispensing valve and for sealing the valve to a component of the package.

It would also be advantageous to provide an improved dispensing system that employs a dispensing valve in an arrangement that can optionally accommodate minimization of gaps or spaces between components of the system.

It would also be beneficial to provide an improved dispensing system that employs a dispensing valve in an arrangement that can optionally be designed to eliminate the need for a snap-fit bead on one or more of the components of the system.

It would also be desirable to provide an improved dispensing system with the optional capability for allowing the user to readily view, target, and control the dispensing of the fluent material from the package.

It would also be beneficial if such an improved dispensing system could optionally readily accommodate the use of a lid or overcap—either as a separate component or as connected with a hinge structure.

It would also be beneficial if an improved dispensing system could readily accommodate manufacture of at least some of the components from a thermoplastic material.

It would also be advantageous if such an improved dispensing system could accommodate bottles, containers, or packages which have a variety of shapes and which are constructed from a variety of materials.

Further, it would be desirable if such an improved system could accommodate efficient, high-quality, high-speed, large volume manufacturing techniques with a reduced product reject rate to produce products having consistent operating characteristics unit-to-unit with high reliability.

BRIEF SUMMARY OF THE INVENTION

The present invention can be incorporated into a dispensing system that may include one or more of the above-discussed, desired features.

The present invention provides an improved dispensing system for a container that has an opening to the container interior. The system can be easily operated by the user to dispense fluent material in a desired direction to a target region that can be readily observed during dispensing.

According to a first aspect of a presently preferred embodiment of the invention, the dispensing system comprises at least a body, a dispensing valve, and a clamp member.

The body is adapted for extending from the container at the opening. The body includes (1) a base for being mounted to, and extending from, the container, (2) a support column projecting outwardly from the base, and (3) a discharge passage through the base and support column.

The dispensing valve comprises flexible, resilient material defining (a) a mounting skirt disposed around the body support column, and (b) an outwardly extending, narrowing dispensing head. The valve mounting skirt defines (a) an interior sealing surface engaging the body support column, and (b) an annular shoulder. The valve head defines a normally closed dispensing orifice which can open to permit flow therethrough in response to a pressure differential across the valve.

The clamp member, preferably in the form of a decorative cone, surrounds at least a portion of the valve skirt. The clamp member has a retention lip that (a) defines an aperture through which the valve head projects, and (b) is engaged with the valve skirt annular shoulder to retain the valve skirt around the body support column. The clamp member also has a retention flange that is engaged with the body to prevent the clamp member from moving outwardly relative to the body and valve.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 11 is a isometric view of the valve of the closure from a vantage point generally above, or from the top of, the valve;

FIG. 12 is an enlarged, cross-sectional view taken generally along the plane 12-12 in FIG. 11;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, many of the figures illustrating the invention show a dispensing closure in the typical orientation that it would have at the top of a container when the container is stored upright on its base, and terms such as upper, lower, horizontal, etc., are used with reference to this position. It will be understood, however, that the closure system of this invention may be manufactured, stored, transported, used, and sold in an orientation other than the position described.

The dispensing system or closure system of this invention is suitable for use with a variety of conventional or special containers having various designs, the details of which, although not illustrated or described, would be apparent to those having skill in the art and an understanding of such containers. The container, per se, that is described herein forms no part of, and therefore is not intended to limit, the present invention. It will also be understood by those of ordinary skill that novel and non-obvious inventive aspects are embodied in the described exemplary dispensing system.

Figure 1:
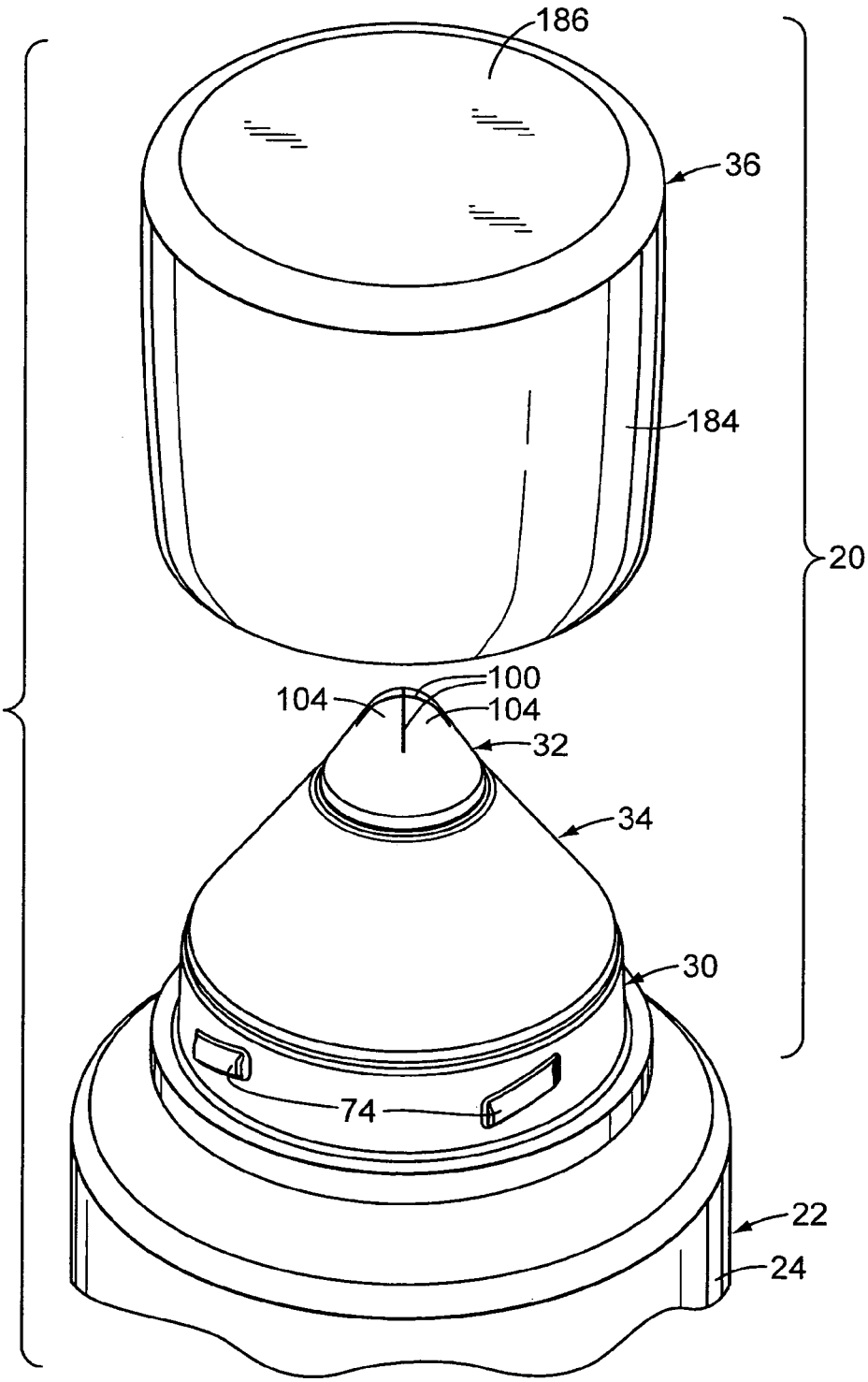
FIG. 1 is an exploded, isometric view of an exemplary dispensing system in the form of a separate dispensing closure according to a preferred embodiment of the invention, and the dispensing closure is shown in FIG. 1 in a non-dispensing configuration, after installation on a container but with the overcap removed, and from a vantage point generally above, or from the top of, the closure.
Figure 2:
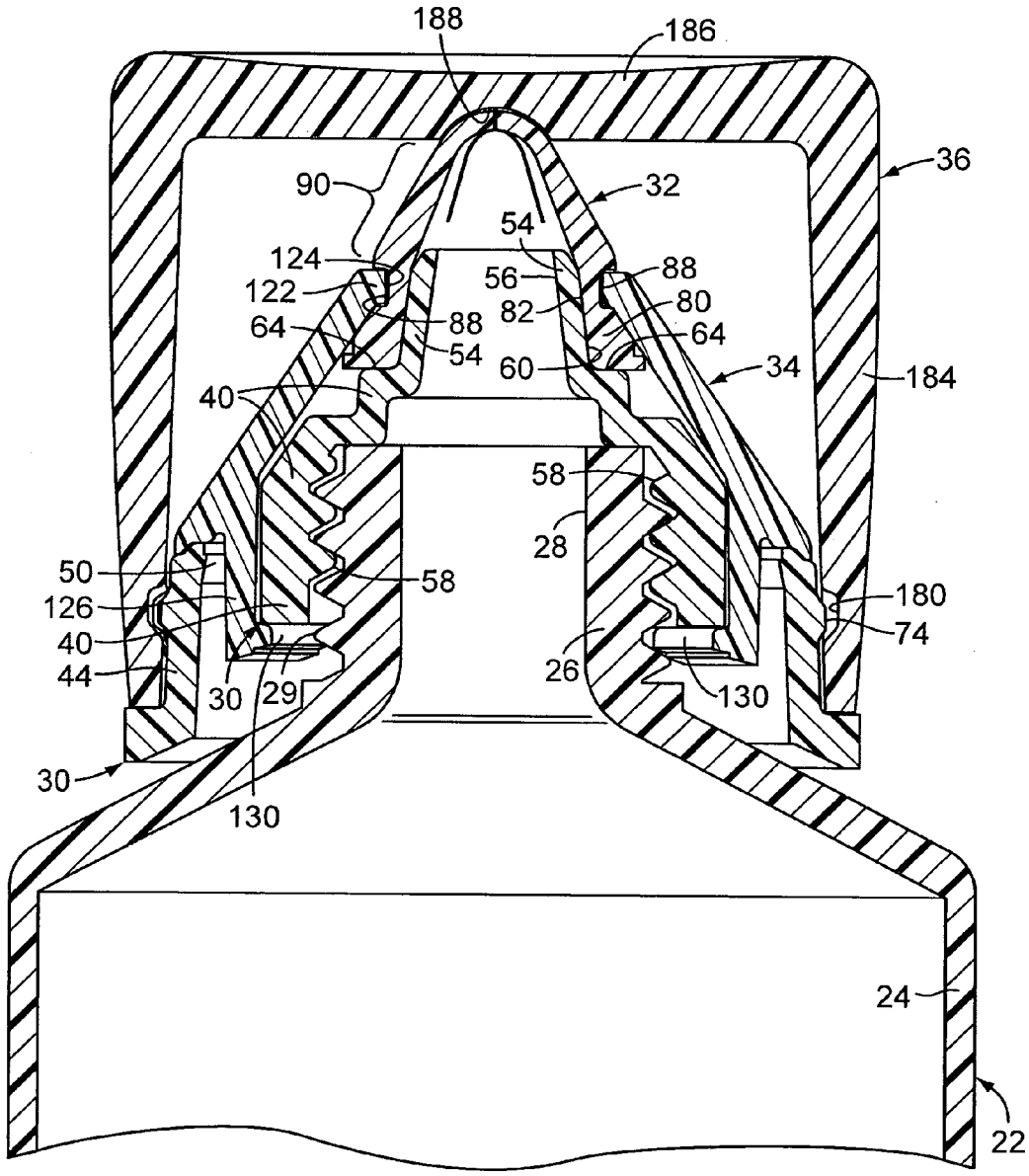
FIG. 2 is a cross-sectional view of the system in FIG. 1, but FIG. 2 shows the overcap installed.

A presently preferred embodiment of a dispensing system of the present invention is illustrated in FIGS. 1-16 and is designated generally therein by reference number 20 in FIG. 1. In the preferred embodiment illustrated, the system 20 is provided in the form of a separate closure 20 which is adapted to be mounted or installed on a container 22 (FIGS. 1 and 2) that would typically contain a fluent material. The container 22 includes body 24 and a neck 26 as shown in FIG. 2. The neck 26 defines an opening 28 to the container interior. The container neck 26, in the preferred embodiment illustrated in FIG. 2, has an external, male thread 29 for engaging the closure 20.

The body 24 of the container 22 may have any suitable configuration, and the upwardly projecting neck 26 may have a different cross-sectional size and/or shape than the container body 24. (Alternatively, the container 22 need not have a neck 26, per se. Instead, the container 22 may consist of just a body with an opening.) The container body 24 may have a rigid wall or walls, or may have a somewhat flexible wall or walls.

Although the container 22, per se, does not form a part of the broadest aspects of the present invention, per se, it will be appreciated that at least a body or base portion of the system 20 of the present invention optionally may be provided as a unitary portion, or extension, of the top of the container 22. However, in the preferred embodiment illustrated, the system 20 is a separate article or unit (e.g., a dispensing closure 20) which can be either one-piece or multiple pieces, and which is adapted to be removably, or non-removably, installed on a previously manufactured container 22 that has an opening 28 to the container interior. Hereinafter, the dispensing system closure 20 will be more simply referred to as the closure 20.

The illustrated, preferred embodiment of the closure 20 is adapted to be used with a container 22 having an opening 28 to provide access to the container interior and to a product contained therein. The closure 20 can be used to dispense with many materials, including, but not limited to, relatively low or high viscosity liquids, creams, gels, suspensions, mixtures, lotions, etc. (such as a material constituting a food product, a beverage product, a personal care product, an industrial or household cleaning product, or other compositions of matter (e.g., compositions for use in activities involving manufacturing, commercial or household maintenance, construction, agriculture, medical treatment, military operations, etc.)).

The container 22 with which the closure 20 may be used would typically be a squeezable container having a flexible wall or walls which can be grasped by the user and squeezed or compressed to increase the internal pressure within the container so as to force the product out of the container and through the opened closure. Such a flexible container wall typically has sufficient, inherent resiliency so that when the squeezing forces are removed, the container wall returns to its normal, unstressed shape. Such a squeezable container is preferred in many applications but may not be necessary or preferred in other applications. For example, in some applications it may be desirable to employ a generally rigid container, and to pressurize the container interior at selected times with a piston or other pressurizing system, or to reduce the exterior ambient pressure so as to suck the material out through the open closure.

It is presently contemplated that many applications employing the closure 20 will conveniently be realized by molding at least some of the components of the closure 20 from suitable thermoplastic material or materials. In the preferred embodiment illustrated, some of the components of the closure could be molded from a suitable thermoplastic material, such as, but not limited to, polypropylene. The closure components may be separately molded—and may be molded from different materials. The materials may have the same or different colors and textures.

Figure 16:
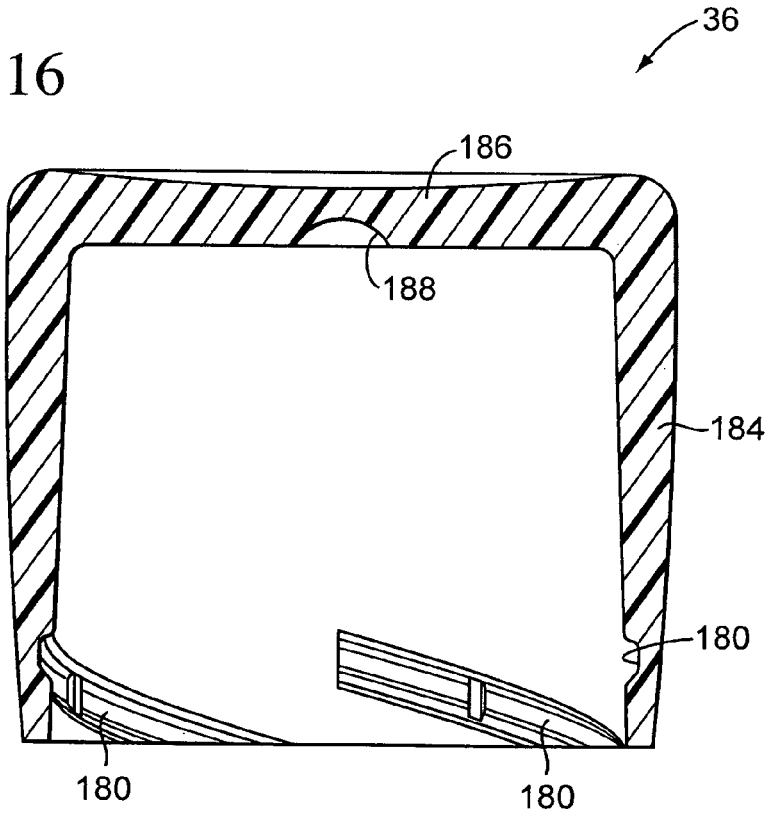
FIG. 16 is a cross-sectional view of the overcap shown in FIG. 1.
Figure 17:
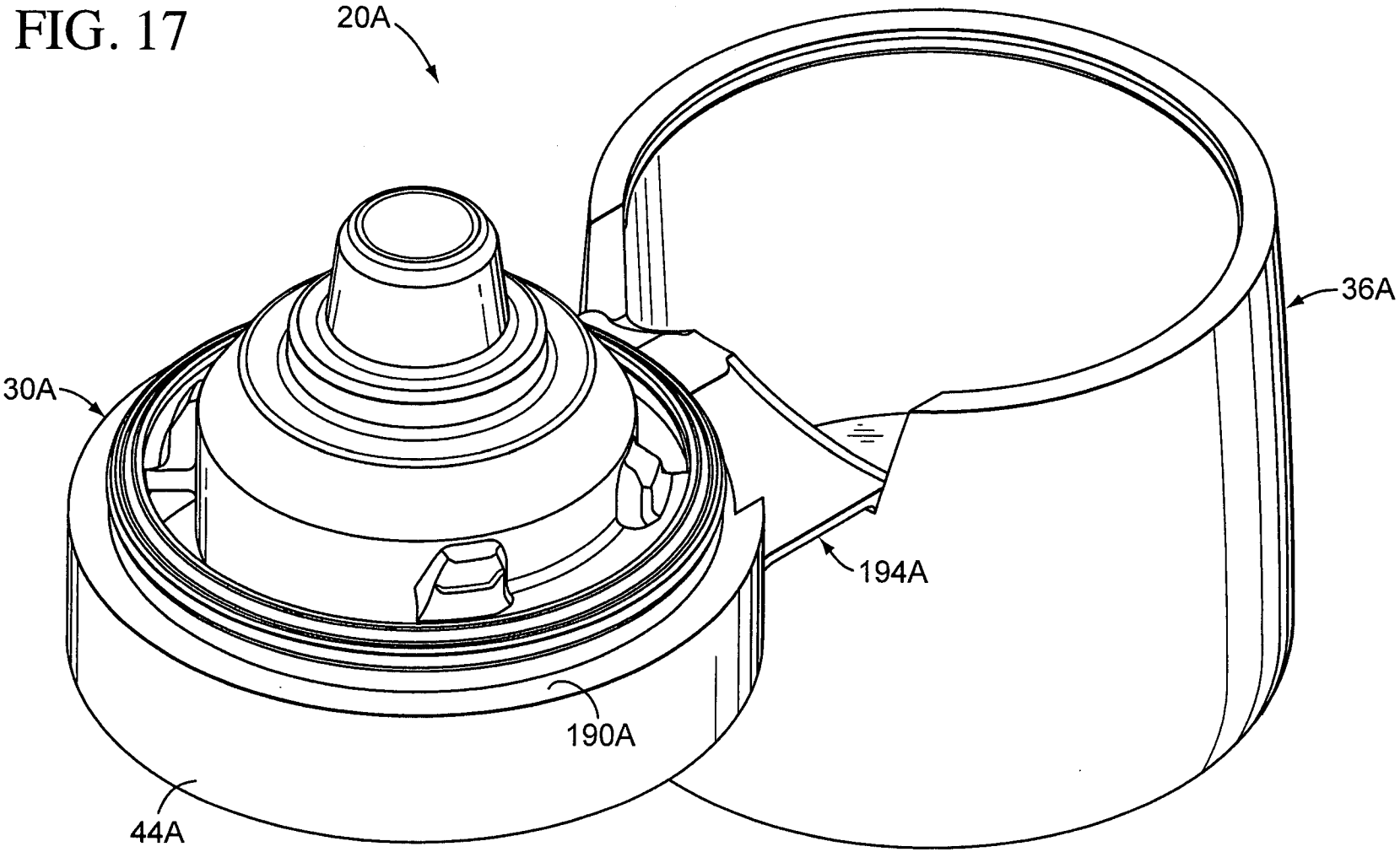
FIG. 17 is a front, isometric view of a second, or alternate, embodiment of the dispensing system of the present invention in the form of a separate closure having a hinged overcap, but FIG. 17 omits the valve component and clamp member component.

As can be seen in FIG. 2, the closure system or closure 20 preferably includes three basic components, (1) a body 30, (2) a dispensing valve 32 which is adapted to be mounted on the body 30, and (3) a decorative cone or clamp member 34 that retains the valve 32 on the upper part of the body 30. In the preferred form of the invention, an optional overcap 36 is provided to cover the valve 32. The overcap 36 can be moved to expose the valve 32 for dispensing. The overcap 36 is movable between (1) a closed position over the body 30, clamp member 34, and valve 32 (as shown in FIG. 2), and (2) an open or removed position. The overcap 36 may be a separate component which is completely removable from the closure body 30 (as in the first embodiment shown in FIGS. 1-16), or the overcap 36 may be tethered to the body with a strap, or the overcap 36 may be hinged to the body 30 so as to accommodate pivoting movement from the closed position to an open position (as shown in FIG. 17).

Figure 8:
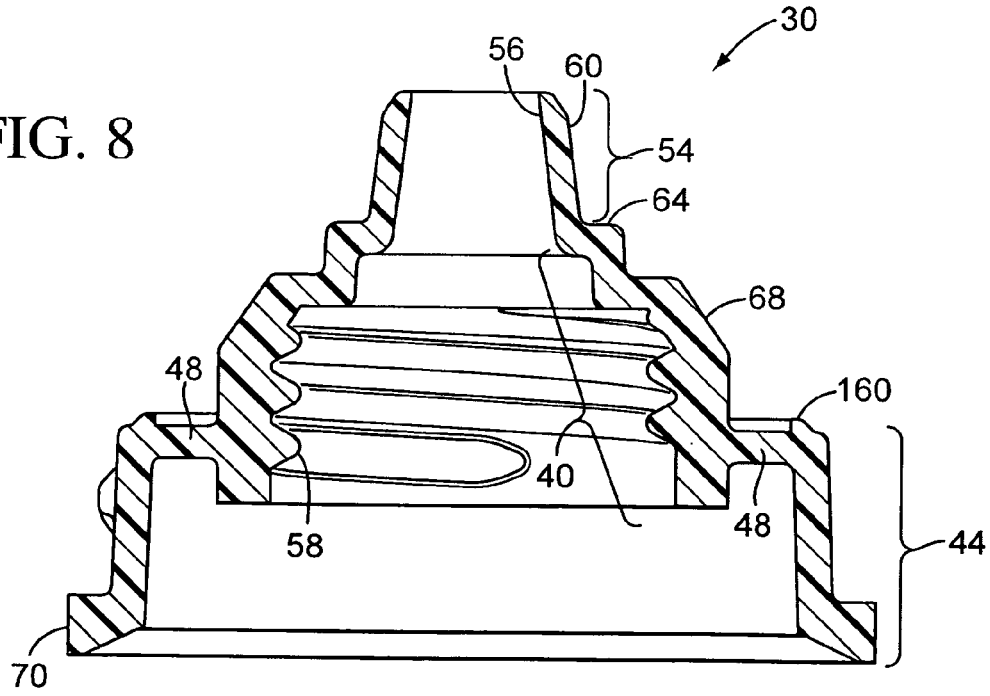
FIG. 8 is a cross-sectional view taken generally along the plane 8-8 in FIG. 6.
Figure 9:
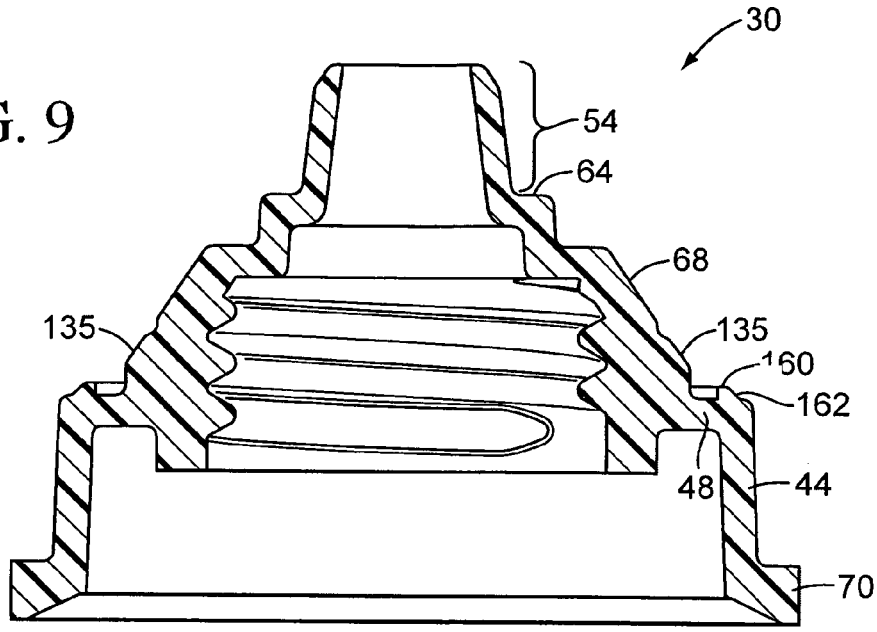
FIG. 9 is a cross-sectional view taken generally along the plane 9-9 in FIG. 6.

As can be seen in FIG. 8, the body 30 includes a base 40 for extending from the container (when the closure body 30 is mounted on the container 22 as shown in FIG. 2). Preferably, a peripheral collar 44 (FIG. 8) extends around the base 40 and is connected to the base 40 with at least one bridge 48 in the preferred embodiment. As can be seen in FIG. 6, there are two bridges 48. At least one slot 50 (FIG. 6) is defined in the body 30. In the preferred embodiment illustrated in FIGS. 5 and 6, there are two slots 50 defined between the body base 40 and the surrounding collar 44.

Figure 5:
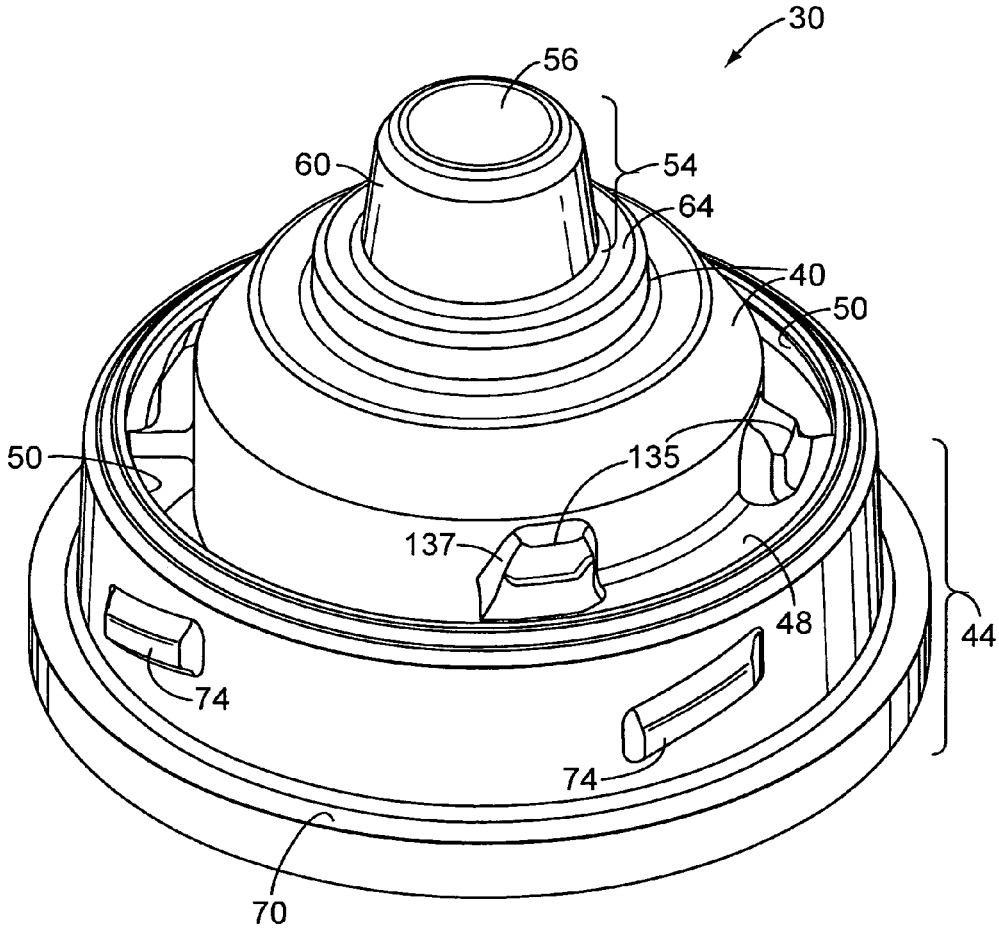
FIG. 5 is a isometric view of the closure body.
Figure 6:
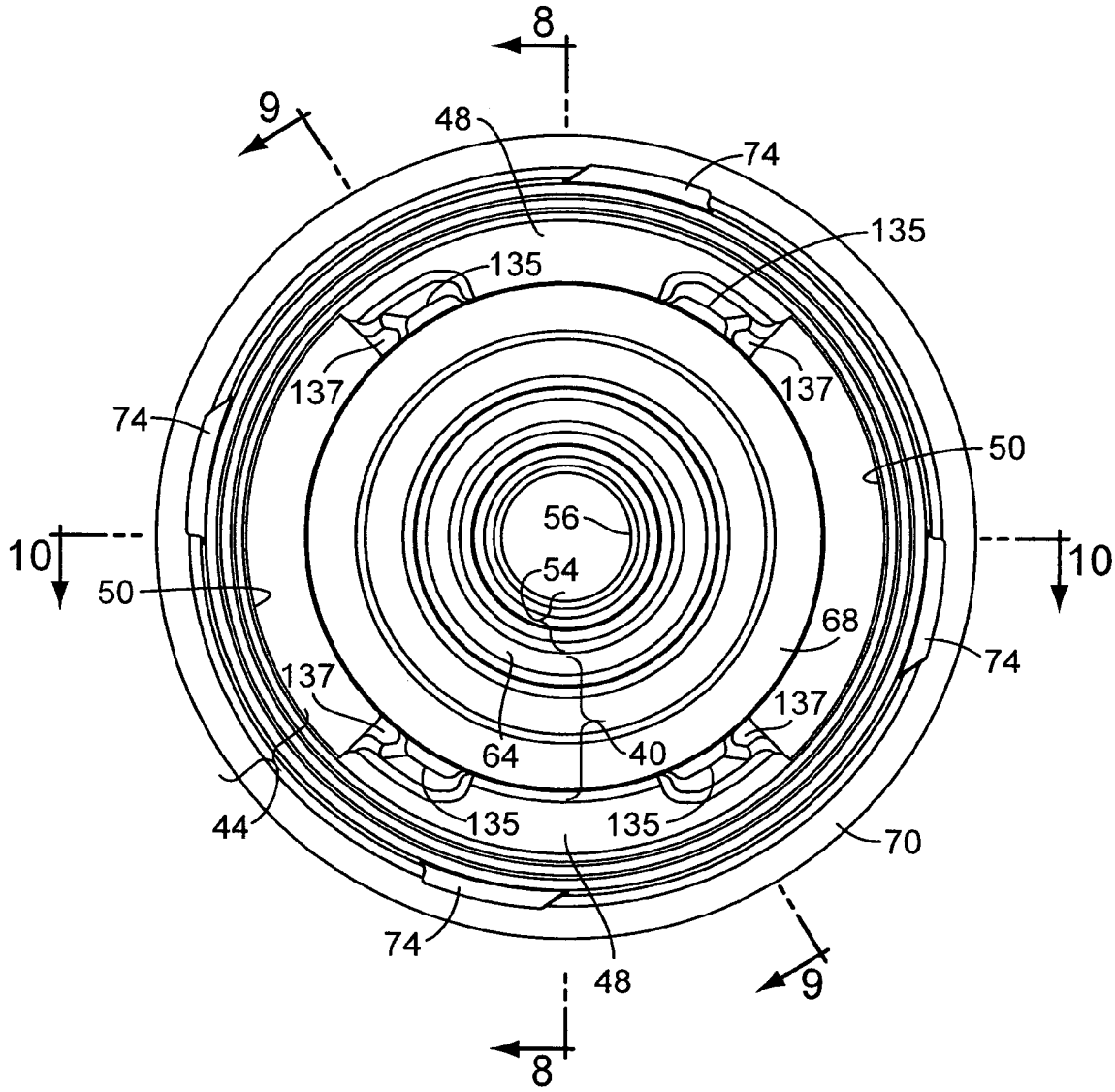
FIG. 6 is a top plan view of the closure body shown in FIG. 5.
Figure 7:
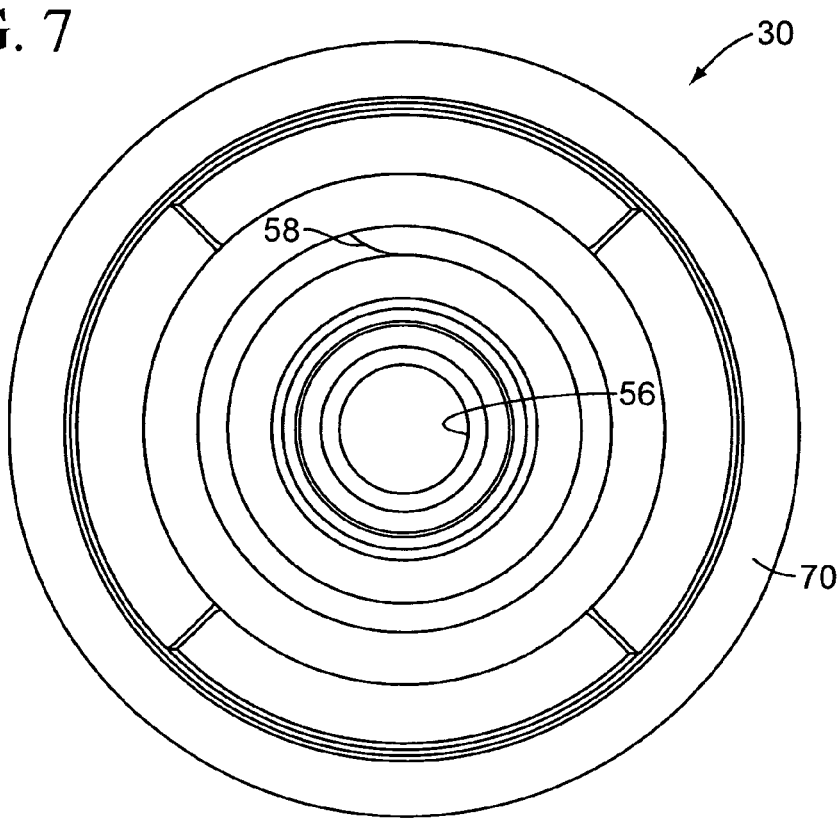
FIG. 7 is a bottom view of the closure body shown in FIGS. 5 and 6.

As can be seen in FIGS. 2 and 5, a spout or support column 54 projects outwardly from the base 40. A discharge passage 56 (FIGS. 2 and 5) extends through the support column 54 and base 40 so as to be in communication with the container opening 28 when the base 40 is installed on the container neck 26 (FIG. 2).

Figure 3:
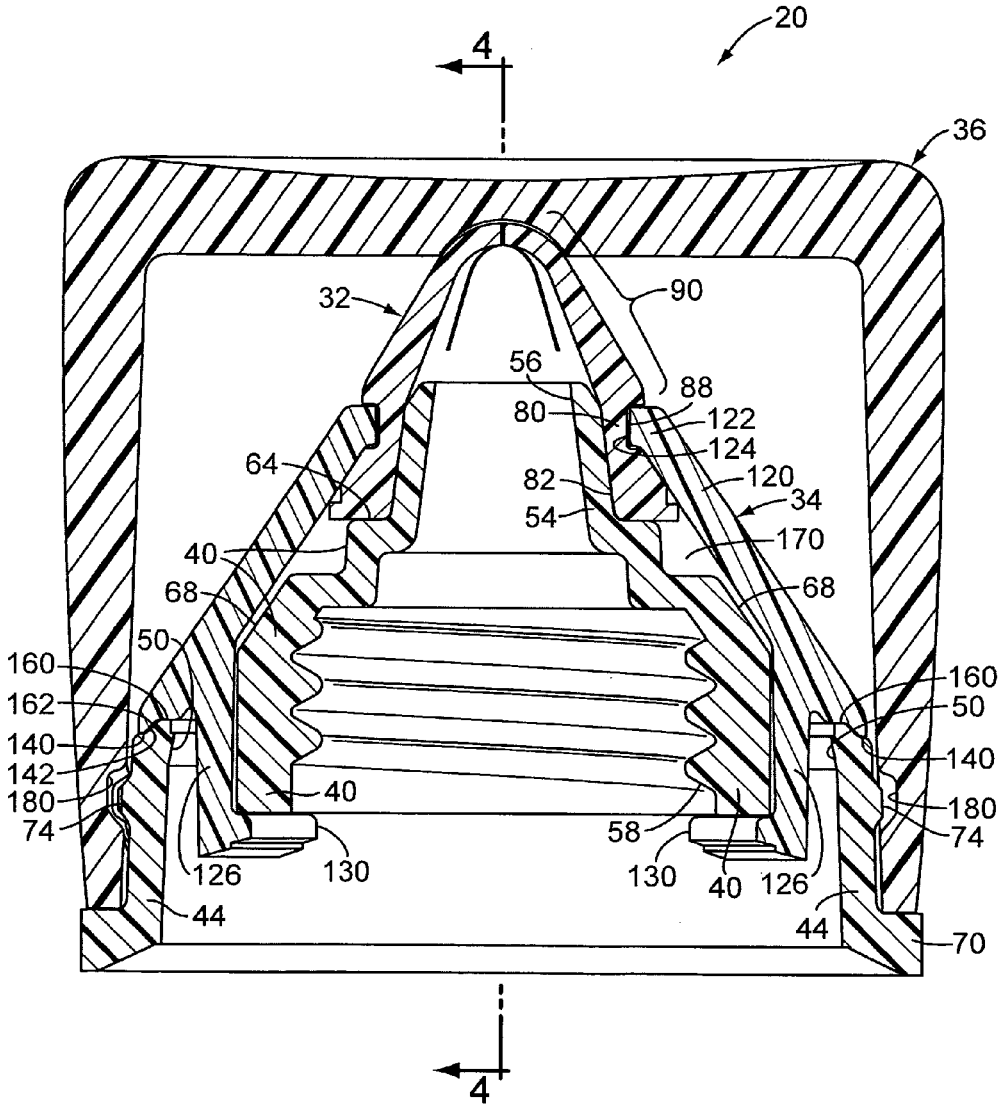
FIG. 3 is a view similar to FIG. 2, but FIG. 3 shows the closure prior to installation on the container.
Figure 4:
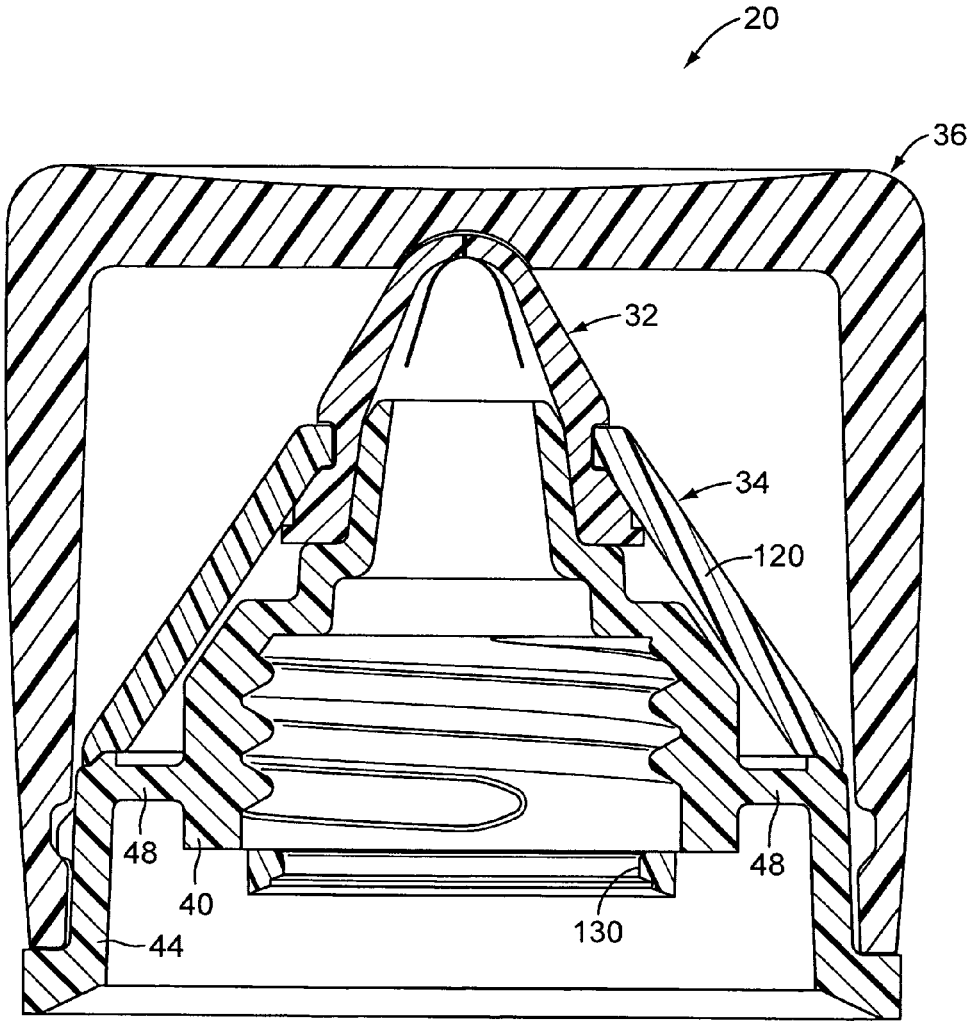
FIG. 4 is a cross-sectional view taken generally along the plane 4-4 in FIG. 3.

As can be seen in FIGS. 2 and 3, the interior of the base 40 defines an internal, female thread 58 for threadingly engaging the container neck external, male thread 29 (FIG. 2) when the dispensing closure body 30 is installed on the container neck 26.

Alternatively, the closure body base 40 could be provided with some other container connecting means, such as a snap-fit bead or groove (not illustrated) for engaging a container neck groove or bead (not illustrated), respectively. Also, the closure body base 40 could instead be permanently attached to the container 22 by means of induction melting, ultrasonic melting, gluing, or the like, depending on materials used for the closure body base 40 and container 22. The closure body base 40 could also be formed as a unitary part, or extension, of the container 22.

The closure body base 40 may have any suitable configuration for accommodating an upwardly projecting neck 26 of the container 22 or for accommodating any other portion of a container received within the particular configuration of the closure body base 40—even if a container does not have a neck, per se. The main part of the container body 24 may have a different cross-sectional shape than the container neck 26 and closure body base 40.

An optional seal or liner (not illustrated) may be sealed across the top of the container neck 26 or, alternatively, may be sealed across an interior region or underside of the upper portion of the closure body base 40. However, if the function of a tamper-evident seal or freshness liner as provided by such a structure is not needed or desired in a particular application, then the structure may, of course, be omitted.

Also, if desired, the closure body base 40 may be provided with an interior, annular seal member (not illustrated) extending downwardly from the underside of the upper portion of the closure body base 40. Such a seal member could be conventional "plug" profile seal, a "crab's claw" seal, a flat seal, a V seal, or some other such conventional or special seal, depending upon the particular application and depending upon whether or not a liner is employed.

In the preferred form of the invention illustrated, the closure body base 40 has a generally annular configuration. However, the closure body base 40 may have other configurations. For example, the closure body base 40 might have a prism or polygon configuration adapted to be mounted to the top of a container neck having a polygon configuration. Such prism or polygon configurations would not accommodate the use of a threaded attachment, but other means of attachment could be provided, such as a snap-fit bead and groove arrangement, adhesive, or the like.

As can be seen in FIG. 8, the preferred form of the closure body support column 54 has an exterior surface 60 which has a frustoconical shape. At the bottom of the support column 54, the upper end of the closure body base 40 preferably defines an upwardly facing, annular, flat shoulder 64 against which the bottom end of the dispensing valve 32 can be disposed (FIG. 2).

As can be seen in FIG. 8, the closure body base 40 preferably has a tapered or frustoconical exterior surface 68 above the bridges 48 and above the slots 50 (FIGS. 3 and 6). The frustoconical surface 68 functions as a lead-in surface to facilitate assembly of the components as described in detail hereinafter.

At the bottom of the collar 44 (FIG. 3), there is a laterally extending, peripheral flange 70. Above the flange 70, in the exterior surface of the collar 44, there is preferably at least one male thread segment 74 (FIGS. 3 and 5). In the preferred embodiment illustrated in FIG. 6, there are four such male thread segments 74 which are adapted to engage the overcap 36 as described in detail hereinafter.

The valve 32 is adapted to be mounted to the closure body spout or support column 54 as shown in FIGS. 2 and 3. The valve 32 is a pressure-actuatable, flexible, slit-type valve which is held on the outside of the spout or support column 54 by means of the clamp member 34 as described in detail hereinafter.

The valve 32 is preferably molded as a unitary structure from material which is flexible, pliable, elastic, and resilient. This can include elastomers, such as a synthetic, thermosetting polymer, including silicone rubber, such as the silicone rubber sold by Dow Corning Corp. in the United States of America under the trade designation D.C. 99-595-HC. Another suitable silicone rubber material is sold in the United States of America under the designation Wacker 3003-40 by Wacker Silicone Company. Both of these materials have a hardness rating of 40 Shore A. The valve 32 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

With reference to FIGS. 11 and 12, the valve 32 includes a base 80. In the illustrated preferred form of the valve, the base 80 has the form of a peripheral mounting skirt 80 for being clamped by the clamp member 34 against the body support column 54. The valve skirt 80 defines an interior sealing surface 82 (FIG. 12). Preferably, the interior sealing surface 82 has a frustoconical configuration to matingly engage, and seal against, the preferred frustoconical form of the exterior surface 60 of the support column 54. The valve skirt 80 also defines a peripheral annular groove 88 (FIGS. 11 and 12) which opens laterally or radially. The bottom of the groove 88 is defined by an annular shoulder 89.

The valve 32 includes a flexible, outwardly extending, narrowing dispensing head 90 as shown in FIGS. 11 and 12, and the head 90 extends outwardly from an upper region of the base or skirt 80 to a dispensing tip. The head 90 extends over the interior volume defined within the flexible base or skirt 80. The head 90 is generally convex (and, in the preferred embodiment is dome shaped) as viewed from the exterior of the valve 32 relative to the interior volume (see FIGS. 11 and 12). The valve head 90 has an interior surface 92 (FIG. 12) that interfaces with the interior volume (and with the product in the container 22). In the preferred the preferred form of the valve, the interior surface 92 is frustoconical below the curved inside surface of the valve head tip. As shown in FIG. 12, the valve head 90 has an exterior surface 96 which interfaces with the ambient environment. The exterior surface 96 narrows, converges, or tapers, but such a narrowing configuration need not be uniform or even continuous. However, according to one preferred aspect of the invention, the valve head 90 has a continuous taper or narrowing over most of its height so as to cooperate with, and follow, the general tapering configuration of the clamp member 34. The distal end or tip of the valve 32 is smaller in cross-sectional size than the base or skirt 80. In the preferred form of the valve 32, the exterior surface 96 is frustoconical between the valve head curved tip and a location just above the base or skirt 80 where the head 90 curves to a vertical orientation at the upper edge of the groove 88. In the illustrated preferred embodiment, the region defined by the exterior surface 96 and interior surface 92 is a wall having a tapering configuration below the valve tip.

In the illustrated preferred the preferred form of valve, the valve 32 has a generally circular configuration about a central longitudinal axis 99 extending through the valve 32 (FIG. 12). The head 90 of the valve 32 has a dispensing orifice. In the preferred embodiment, the orifice is defined by one or more slits 100 (FIG. 12). Preferably, there are two or more slits 100 radiating laterally from the longitudinal axis 99. More preferably, there are four slits 100 that radiate from the axis 99. The four radiating slits 100 may be alternatively characterized as two intersecting cross slits 100. A lesser or greater number of slits 100 could be used. The slits 100 preferably extend transversely through head portion 90 between the exterior surface 96 and the interior surface 92.

In the illustrated preferred form of the valve 32, the slits 100 extend laterally from a common origin on the longitudinal axis 99 to define four flaps or petals 104 (FIG. 11) which can flex outwardly to selectively permit the flow of product from the container 22 through the valve 32. Each slit 100 terminates in a radially outer end that is also the bottom end of the slit. In the illustrated preferred form of the valve, the slits 100 are of equal length, although the slits 100 could be of unequal length.

In the preferred form of the valve, each slit 100 is planar, and the plane of each slit 100 contains the central, longitudinal axis 99 of the valve 32. Preferably, the slits 100 diverge from an origin on the longitudinal axis 99 and define equal size angles between each pair of adjacent slits 100 so that the flaps 104 are of equal size. Preferably, the four slits 100 diverge at 90 degree angles to define two mutually perpendicular, intersecting, longer slits. Preferably, the slits 100 are formed so that the opposing side faces of adjacent valve flaps 104 closely seal against one another when the dispensing orifice is in its normal, fully closed position. The length and location of the slits 100 can be adjusted to vary the predetermined opening pressure of the valve 32, as well as other dispensing characteristics.

The tip portion or tip of the valve head 90 includes at least the upper end portions of the slits 100. In the preferred illustrated form of the valve head 90, the tip portion or tip is defined as the region within the angle X (FIG. 12). In the preferred form of the valve, the tip wall thickness (C in FIG. 12) is equal to, or less than, the smallest thickness of the tapering wall between the exterior surface 96 and the interior surface 92.

In the preferred form of the valve 32, the slits 100 each extends downwardly from the tip portion into the tapering wall below the tip portion to define an outside vertical lateral edge 107 parallel to the longitudinal axis 99.

In the presently preferred form of the valve 32 illustrated in FIGS. 11 and 12, a typical size valve 32 molded from silicone has four slits 100. It is to be understood that the valve dispensing orifice may be defined by structures other than the illustrated slits 100. If the orifice is defined by slits, then the slits may assume many different shapes, sizes and/or configurations in accordance with those dispensing characteristics desired. For example, the orifice may also include five or more slits, particularly when larger or wider streams are desired, and/or the product is a particulate material or a liquid containing aggregates.

The dispensing valve 32 is preferably configured for use in conjunction with a particular container, and a specific type of product, so as to achieve the exact dispensing characteristics desired. For example, the viscosity and density of the fluid product can be factors in designing the specific configuration of the valve 32 for liquids, as is the shape, size, and strength of the container. The rigidity and durometer of the valve material, and size and shape of the valve head 90, are also important in achieving the desired dispensing characteristics, and can be matched with both the container and the material to be dispensed therefrom.

The valve 32 is especially suitable for dispensing flowable products, such as liquids or even gases, powders, particulates, or granular material, as well as suspensions of solid particles in a liquid. The valve 32 is particularly suitable for dispensing shampoos, liquid toothpaste, thin oils, thick lotions, water, and the like.

It is to be understood that, according to the present invention, portions of the valve 32 may assume different shapes and sizes, particularly in accommodating the type of container and product to be dispensed therefrom. The predetermined opening pressure of the valve 32 may be varied widely in accordance with those dispensing criteria desired for a particular product. Flow characteristics of the dispensed product can also be adjusted substantially, such as for relatively wide column-like streams, thin needle-like streams, multiple streams, variations thereof, and the like.

In one presently preferred form of the valve 32 illustrated in FIGS. 11 and 12, the various dimensions designated with letters in FIG. 12 have preferred values as follows:

The width A of two aligned slits 100 across the diameter is 0.140 inch.

The maximum inside diameter B of the valve head interior surface 92 at the bottom of the surface 92 is 0.168 inch.

The thickness C of the valve head 90 at the distal end of the tip (where all four slits 100 meet) is 0.020 inch.

The distance D from the lowermost point of each slit 100 on the exterior surface 96 of the valve head 90 to the top of the slits 100 at the exterior of the tip of the valve head 90 is 0.055 inch.

The height E from the bottom of each slit 100 to the top of the slit 100 at the exterior of the tip of the valve head 90 is 0.115 inch.

The distance F from the bottom of the frustoconical exterior surface 96 of the valve head 90 to the top of the valve head 90 is 0.150 inch.

The height G from the upper edge of the annular groove 88 to the top of the slits 100 at the exterior of the tip of the valve head 90 is 0.165 inch.

The maximum thickness $T_1$ of each valve slit 100 at the lowermost point of the slit on the exterior surface of the valve head 90, as measured perpendicular to the valve head interior surface 92, is 0.023 inch.

The maximum thickness $T_2$ of the wall of the valve head 90 at the lowermost point of the slit on the interior surface of the valve head 90, as measured perpendicular to the valve head interior surface 92, is 0.031 inch.

The maximum thickness $T_3$ of the wall of the valve head 90 at the bottom of the valve head frustoconical exterior surface 96 (at the bottom of dimension F), as measured perpendicular to the interior surface 92, is 0.037 inch.

As viewed in the vertical cross section shown in FIG. 12, the tip portion at the top of the preferred embodiment of the valve head 90 has a circular arc interior surface (i.e., partially spherical) and a circular arc exterior surface (i.e., partially spherical), and the angle X of the circular arc is 136 degrees. In this preferred configuration, the wall of the tip is an arcuate (i.e., partially spherical) wall having a uniform thickness equal to the smallest thickness of the tapering wall extending downwardly from the tip.

The angle Y of the valve head exterior frustoconical surface 96 relative to the central, longitudinal axis 99 is 30 degrees.

The angle Z of the valve head frustoconical interior surface 92 to the central, longitudinal axis 99 is 22 degrees.

Preferably, the wall thickness of the illustrated preferred form of the valve head 90 continuously decreases over (along) most of the height at least to the tip (i.e., at least up to the lines defining the angle X in FIG. 12). The wall thickness of the tip is preferably equal to, or less than, the smallest thickness of such a tapering wall.

Further, for the particular preferred embodiment of the valve head 90 having the above-listed dimensions, the overall maximum external diameter of the valve head 90 just above the groove 88 is about 0.250 inch. The radius of the exterior surface of the valve head tip is 0.067 inch, and the concentric interior surface at the tip has a radius of 0.047 inch.

According to presently preferred embodiments of the valve, the width A of the two aligned slits 100 across the valve diameter is preferably in the range of between about 30% and about 80% of the maximum inside diameter B of the valve head interior surface 92 (at the bottom of the surface 92). Also, preferably, the thickness C of the valve head 90 at the end of the tip (where all four slits 100 meet) is between about 30% and about 80% of the maximum thickness $T_3$ of the wall of the valve head 90. Preferably, the height G from the upper edge of the annular groove 88 to the top of the slits at the exterior of the tip of the valve head 90 is between about 30% and about 180% of the maximum inside diameter B of the valve head interior surface 92 at the bottom of the surface 92.

Owing to the unique configuration of the valve 32, the valve 32 normally remains in the closed configuration shown in FIGS. 1, 11, and 12 unless it is subjected to opening forces. The valve 32 can be moved to an open configuration by applying a sufficiently large pressure differential across the valve head 90 when the valve 32 is in the closed configuration so that the pressure acting on the exterior of the valve head 90 is lower than the pressure acting on the interior of the valve head 90. Such a pressure differential forces the valve petals or flaps 104 upwardly (i.e., outwardly) to the open position. The opening pressure differential can be achieved by pressurizing the interior of the container 22 to which the closure 20 is mounted. Typically, the container 22 would have a flexible wall which can be squeezed inwardly by the user to increase the pressure within the container 22. This can be done while holding and squeezing the container 22 (with the closure 20 mounted thereon) in an inverted orientation so that the fluent material or other product within the container 22 is pressurized against the closed valve 32. As the pressure moves the valve petals 104 to the open positions, the material or product flows through the open slits 100 and past the open valve petals 104.

The valve 32 could also be opened by a user sucking on the valve with sufficient force to lower the pressure on the valve head exterior surface 96 below the internal pressure acting against the valve head interior surface 92.

If the container 22 on which the closed valve 32 is mounted inadvertently tips over after the overcap 36 is removed, then the product still does not flow out of the valve 32 because the valve 32 remains closed. Preferably, the valve 32 is designed to withstand the weight of the fluid on the inside of the valve 32 when the container 22 is completely inverted. Preferably, the valve 32 is designed to open only after a sufficient amount of pressure differential acts across the valve—as by the user sucking on the end of the valve 32 with sufficient force and/or squeezing the container 22 with sufficient force (if the container 22 is not a rigid container).

When dispensing product through the preferred form of the valve 32 in the open condition, if the differential pressure across the valve 32 decreases sufficiently, then the inherent resiliency of the valve 32 will cause it to close. The valve 32 will then assume the closed position illustrated in FIGS. 1, 11, and 12. However, it is contemplated that the valve 32 could also be designed for a "once-open, stay-open" operation by using an appropriate shape for the valve head 90 with appropriate dimensions for the valve head thickness and slit lengths.

In one preferred form of the valve, the petals of the valve 32 open outwardly only when the valve head 90 is subjected to a predetermined pressure differential acting in a gradient direction wherein the pressure on the valve head interior surface 92 exceeds—by a predetermined amount—the local ambient pressure on the valve head exterior surface 96. The product can then be dispensed through the open valve 32 until the pressure differential drops below a predetermined amount, and the petals 104 then close completely.

In one optional form of the valve 32, the valve 32 can be designed to be flexible enough to accommodate in-venting of ambient atmosphere as described in detail below, then the closing petals 104 can continue moving inwardly to allow the valve to open inwardly as the pressure differential gradient direction reverses and the pressure on the valve head exterior surface 96 exceeds the pressure on the valve head interior surface 92 by a predetermined amount.

For some dispensing applications, it may be desirable for the valve 32 not only to dispense the product, but also to accommodate such in-venting of the ambient atmosphere (e.g., so as to allow a squeezed container (on which the valve is mounted) to return to its original shape). Such an in-venting capability can be provided by selecting an appropriate material for the valve construction, and by selecting appropriate thicknesses, shapes, and dimensions for various portions of the valve head 90 for the particular valve material and overall valve size. The shape, flexibility, and resilience of the valve head, and in particular, of the petals 104, can be designed or established so that the petals 104 will deflect inwardly when subjected to a sufficient pressure differential that acts across the head 90 and in a gradient direction that is the reverse or opposite from the pressure differential gradient direction during product dispensing. Such a reverse pressure differential can be established when a user releases a squeezed, resilient container 22 on which the valve 32 is mounted. The resiliency of the container wall (or walls) will cause the wall to return toward the normal, larger volume configuration. The volume increase of the container interior will cause a temporary drop in the interior pressure. When the interior pressure drops sufficiently below the exterior ambient pressure, the pressure differential across the valve 32 will be large enough to deflect the valve petals 104 inwardly to permit in-venting of the ambient atmosphere. In some cases, however, the desired rate or amount of in-venting may not occur until the squeezed container is returned to a substantially upright orientation that allows the product to flow under the influence of gravity away from the valve 32.

The illustrated preferred form of the valve 32 provides an improved dispensing valve with the capability for allowing the user to readily view, target, and control the dispensing of the fluent material from the valve. The valve 32 can function to dispense a product accurately while minimizing the likelihood of accidental, premature, or undesired product discharge, and while providing good product cut-off at the termination of dispensing with little or no mess of product left on the exterior of the valve (or package containing the valve). The closed valve can minimize, or at least reduce, the likelihood either of the product drying out in the package or being contaminated.

The illustrated preferred form of the valve 32 has a sleek, directional appearance. Because the valve head tapers (becomes narrow) toward the end of the tip portion (where the intersecting slits 100 meet), and because the wall thickness is thinner in the tip portion, the valve has less resistance to opening than some other valve configurations that lack such a configuration. Thus, the valve 32 can be easier to open (e.g., requiring less squeezing pressure on a container to which the valve is mounted). Because the wall of the valve 32 is increasingly thicker in the direction away from the dispensing tip portion, the valve 32 can exhibit a desired, sufficient reclosing strength to close the petals 104 in response to a predetermined decrease in differential pressure across the open valve petals.

As can be seen in FIG. 2, the valve 32 is preferably installed so that the bottom annular surface of the valve 32 is seated close to, or in engagement with, the annular shoulder 64 of the body 30. The valve 32 is held tightly engaged with the body spout or support column 54 by the clamp member 34. The clamp member 34 functions to retain the valve 32 in the proper position and also provides a decorative or aesthetic function of covering a lower portion of the valve 32 and a lower portion of the body 30.

Figure 13:
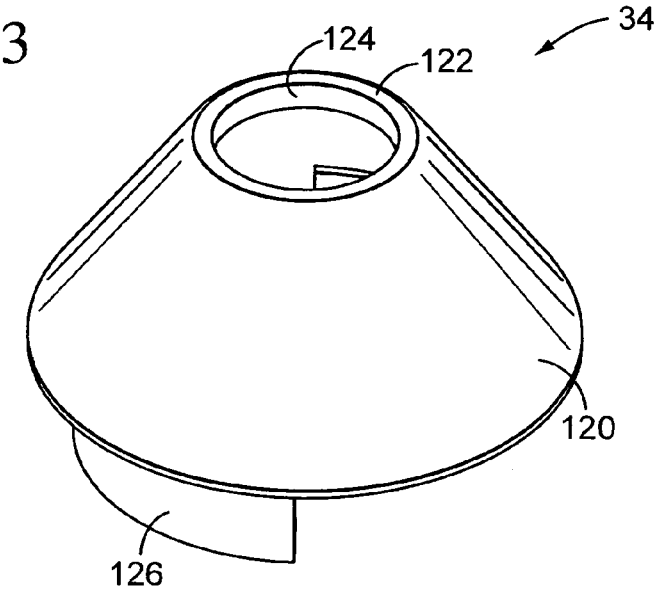
FIG. 13 is an isometric view of the clamp member of the closure from a vantage point generally above, or from the top of, the clamp member.
Figure 14:
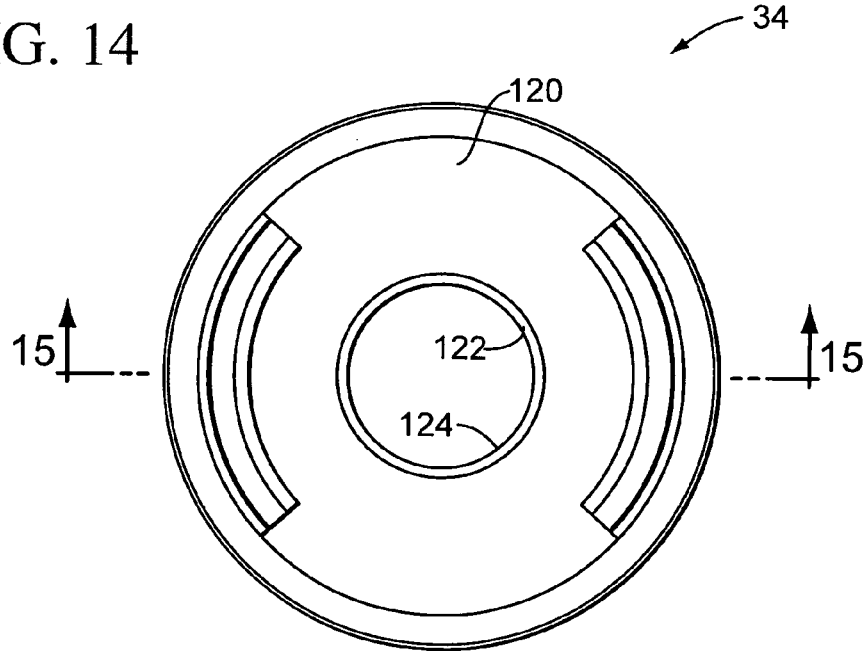
FIG. 14, is a bottom view of the clamp member shown in FIG. 13.
Figure 15:
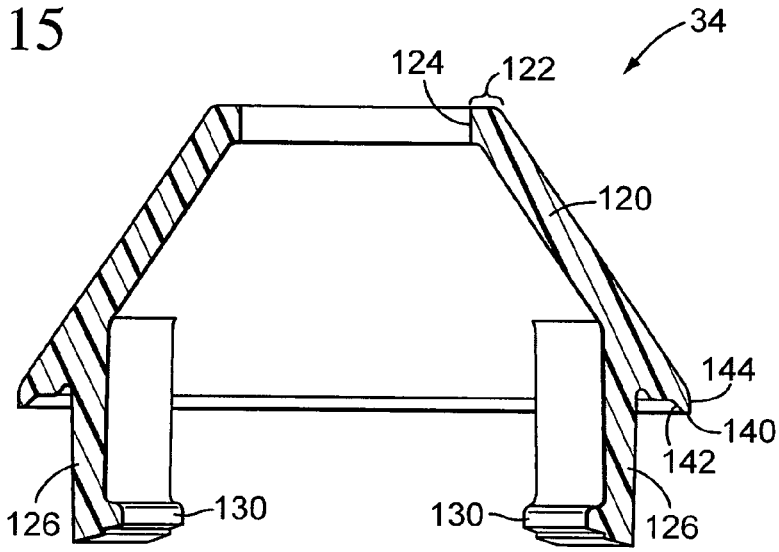
FIG. 15 is a cross-sectional view taken generally along the plane 15-15 in FIG. 14.

As can be seen in FIGS. 13-15, the clamp member 34 preferably defines a frustoconical portion 120. The upper end of the frustoconical portion 120 extends radially laterally inwardly toward the valve 32 to define an annular, distal lip or retention lip 122. The retention lip 122 defines an aperture 124 through which the valve head 90 projects as can be seen in FIG. 2. The clamp member annular, retention lip 122 is received in the valve skirt annular groove 88 to retain the valve skirt 80 around the body support column 54. The valve skirt interior surface 82 sealingly engages the exterior surface 60 of the support column 54.

The clamp member 34 includes at least one, and preferably two, legs 126 (FIG. 15) which project inwardly (i.e., downwardly). A retention flange 130 extends from each clamp member leg 126. When the body 30, valve 32, and clamp member 34 are assembled as shown in FIG. 3, each clamp member leg 126 projects through one of the body slots 50 so that the retention flange 130 at the bottom of each leg 126 extends beneath, and is engaged with, a bottom edge of the closure body base 40 (FIG. 3).

To initially assemble the closure components, the valve 32 is first disposed on the support column 54 of the closure body 30, and then the clamp member 34 is pushed down over the valve 32 until the clamp member lip 122 is received in the valve annular groove 88. The valve 32 is sufficiently resilient to temporarily deform so as to accommodate the proper seating of the clamp member lip 122 in the valve annular groove 88. As the clamp member 34 is pushed downwardly over the valve 32, the body support column 54 inside the valve 32 maintains the valve 32 in position and prevents collapse of the valve skirt 80. As the clamp member 34 is pushed down over the valve 32, the distal ends of each clamp member leg flange 130 engage the body base frustoconical surface (i.e., lead-in surface) 68 and slide downwardly therealong. As the clamp member 34 is pushed downwardly with sufficient force, the clamp member legs 126 expand or spread apart laterally outwardly so that the flanges 130 move along the body base frustoconical surface 68 to the bottom edge (i.e., outer edge) of the frustoconical surface 68 and then move vertically downwardly through the slots 50 between the closure body base 40 and the surrounding closure body collar 44 so that the flanges 130 can snap under the bottom of the closure body base 40 owing to the inherent resiliency of the material from which the clamp member 34 is made (e.g., polypropylene in a presently preferred embodiment).

When the clamp member flanges 130 snap in under the bottom edge of the closure body base 40 (FIG. 3), the clamp member 34 functions to maintain the lower portion of the valve skirt 80 in compression against the closure body support column 54, and preferably also against the closure body upwardly facing shoulder 64 (FIG. 3). This arrangement locks together the three components (i.e., the valve 32, the body 30, and the clamp member 34) in the desired assembled relationship with the appropriate sealing surfaces tightly engaged.

The closure body 30 includes an optional, special feature to aid in the installation of the preferred embodiment of the clamp member 34. Specifically, the closure body 30 preferably includes two pairs of guide ribs 135 (FIG. 5). Each bridge 48 is associated with a pair of the guide ribs 135 (FIG. 5). Each guide rib 135 projects upwardly from a bridge 48. Each rib 135 is located at an edge of a bridge 48 adjacent one of the slots 50. Each rib 135 has an angled surface 137 (FIG. 5). As can be seen in FIG. 6, each slot 50 terminates at each end adjacent one of the guide rib slanted surfaces 137. As the clamp member 34 is installed over the valve 32 and onto the closure body 30, the clamp member leg flanges 130 might not be positioned exactly in registration with the closure body slots 50. If there is such a slight misalignment as the clamp member 34 is lowered onto the body 30, the angled surfaces 137 of the guide ribs 135 will serve to properly guide the clamp member legs 126 so that the legs 126 and flanges 130 become properly registered with, and can pass through, the slots 50. Also, once the components are assembled, the ends of the bridges 48 at the bottom of the rib angled surfaces 137 prevent relative rotation between the clamp member 34 and the body 30 (and valve 32).

Figure 10:
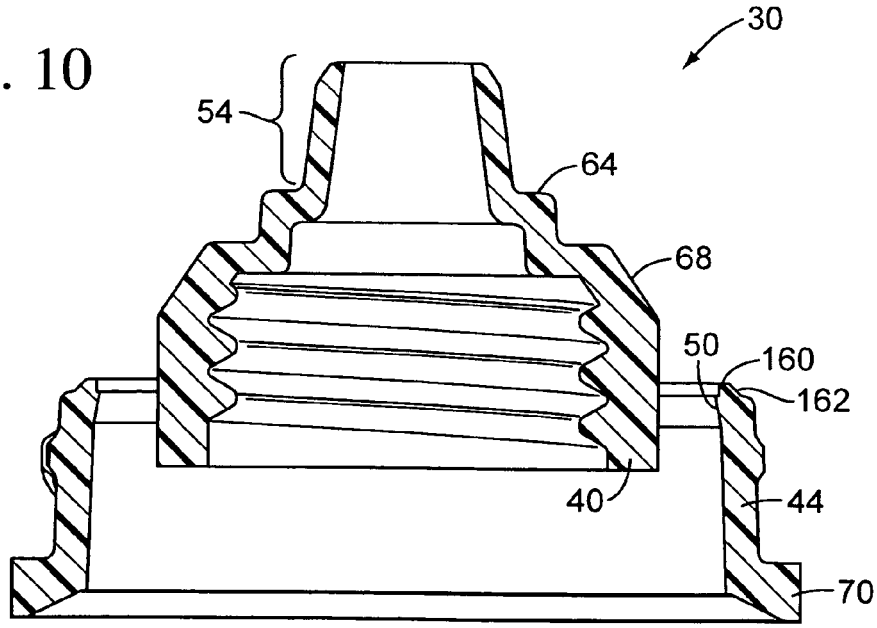
FIG. 10 is a cross-sectional view taken generally along the plane 10-10 in FIG. 6.

With reference to FIG. 15, the clamp member 34 includes a peripheral lip 140 at the lower end of the frustoconical portion 120. The lip 140 includes an angled, inwardly facing surface 142 and a generally cylindrical outwardly facing surface 144. The lip 140, and its surfaces 142 and 144, provide an aesthetic function in cooperation with the upper end of the closure body collar 44. Specifically, the upper end of the closure body collar 44 has a peripheral lip 160 (FIGS. 9 and 10) which is adapted to fit laterally inwardly of, and adjacent, the clamp member lip 140 when the clamp member 34 is installed over the valve 32 and body 30 (as illustrated in FIG. 2). The body collar peripheral lip 160 defines a laterally outwardly facing, angled or frustoconical surface 162 (FIG. 10). Preferably, the clamp member bottom lip inner surface 142 has the same shape or angle as the shape or angle of the closure body collar lip outer surface 162 so that when the clamp member 34 is installed as shown in FIG. 3, the surfaces 142 and 162 are generally parallel, and can be in substantially mating engagement. Owing to the configuration of the surfaces 142 and 162, the system can accommodate manufacturing tolerances that affect the final vertical position or location of the components. For example, depending upon the "as-manufactured" location of the upper horizontal surface of the clamp member flanges 130 relative to the vertical location of the clamp member peripheral lip 140 (FIG. 3), the lip 140 could be spaced upwardly a small amount from the top end of the closure body collar 44 after the components are assembled. Such a small upward spacing resulting from manufacturing tolerances will be less aesthetically objectionable because the closure body collar lip 160 extends upwardly closely behind (i.e., radially inwardly from) the clamp member lip 140. Thus, the slanted surface 162 of the closure body collar lip 160 would be immediately visible in the gap between the bottom of the clamp member lip 140 and the upper end of the closure body collar 44. This would limit the inward extent of the gap and would provide a more "finished" appearance.

Additionally, the angle of the larger frustoconical exterior surface of the frustoconical portion 120 of the clamp member 34 is preferably designed to generally match the angle of the head 90 of the valve 32 (see FIGS. 12 and 1) so that the closure 20 (after removal of any overcap 36) appears to the user to have a sleek, generally smooth, tapering or narrowing configuration which assists in helping the user target the dispensing of the product to a desired target region. The overall tapering design of the dispensing system provides or enhances a capability to more easily direct the discharge of the product being dispensed from the closure 20. The generally smooth, clean, tapering configuration is also relatively easy to keep clean.

The sealing of the valve 32 against its interior surface 82 is effected through a combination of longitudinally and laterally directed force components, and this is very effective in providing proper sealing, and this arrangement accommodates ease of assembly. The valve 32 does not need to have a peripheral bottom flange subjected to purely vertical compression forces.

However, if an increased retention capability is desired in some applications, the bottom of the valve skirt 80 can be modified. In particular, with reference to FIG. 3, there is an annular space or volume 170 adjacent the clamp member frustoconical portion 120 just below the bottom of the valve 32. If an increased clamping or retention capability is desired, the bottom of the valve 32 could be designed to include additional material that would occupy some or all of the void space 170 of the illustrated embodiment in FIG. 3.

In the preferred embodiment illustrated in FIGS. 1-16, the use of the clamp member 34 with the snap fit legs 126 and flanges 130 eliminates the need for special, smaller snap beads on the closure body 30 per se.

In the preferred embodiment illustrated in FIGS. 1-16, the overcap 36 is adapted to be threadingly engaged with the closure body 30. To this end, the closure body collar thread segments 74 are adapted to be received in a threading engagement with female thread segments or grooves 180 (FIG. 16) which are defined in the overcap 36. Specifically, the overcap 36 has a skirt 184 and a top portion 186. The female grooves or female thread segments 180 are formed in the lower portion of the inside surface of the overcap skirt 184 (FIG. 16).

The overcap top portion 186 is preferably provided with a downwardly open, partially spherical surface 188 (FIG. 16) for covering the outer, distal end surface of the valve head 90 (as shown in FIG. 2) when the overcap 36 is installed. The close fitting relationship between the overcap surface 188 and the valve head 90 serves to prevent unintended opening of the valve 32 during shipping, storage, and handling if the container 22 is accidentally subjected to impact forces of a magnitude that would be sufficient to cause opening of the valve 32 in the absence of the overcap.

A second or alternate embodiment of the dispensing system 20A is illustrated in FIG. 17. The second embodiment 20A does not illustrate the complete assembly of all of the components. Rather, FIG. 17 illustrates only the closure body 30A with an attached lid 36A. It is to be understood that a valve (such as the valve 32 described above with reference to the first embodiment illustrated in FIGS. 1-16) and a clamp member (such as the clamp member 34 described above with reference to the first embodiment illustrated in FIGS. 1-16), would be installed on the closure body 30A of the second embodiment. Many of the features of the second embodiment closure body 30A are identical with the features of the first embodiment closure body 30 described above with reference to FIGS. 1-16. However, the second embodiment closure body 30A has a modified peripheral collar 44A which does not have exterior male thread segments (such as the male thread segments 74 illustrated in FIG. 5 for the first embodiment closure body 30). Further, the second embodiment closure body collar 44A has an upper end defining a generally flat, annular shoulder 190A against which the bottom of the overcap 36A is adapted to be disposed when the overcap 36A is in the closed position (not illustrated).

The second embodiment closure body collar 44A also is attached to the overcap 36A with a hinge 194A. The hinge 194A may be of any suitable type (such as, for example, a snap-action hinge). The particular design and configuration of the hinge 194A forms no part of the present invention.

The other features of the closure body 30A radially inwardly of the collar 44A are substantially identical with the features of the first embodiment closure body 30 described above with reference to FIGS. 1-16. Thus, the second embodiment closure body 30A can receive a valve and clamp member (such as the valve 32 and clamp member 34 described above with reference to the first embodiment illustrated in FIGS. 1-16).

Figure 18:
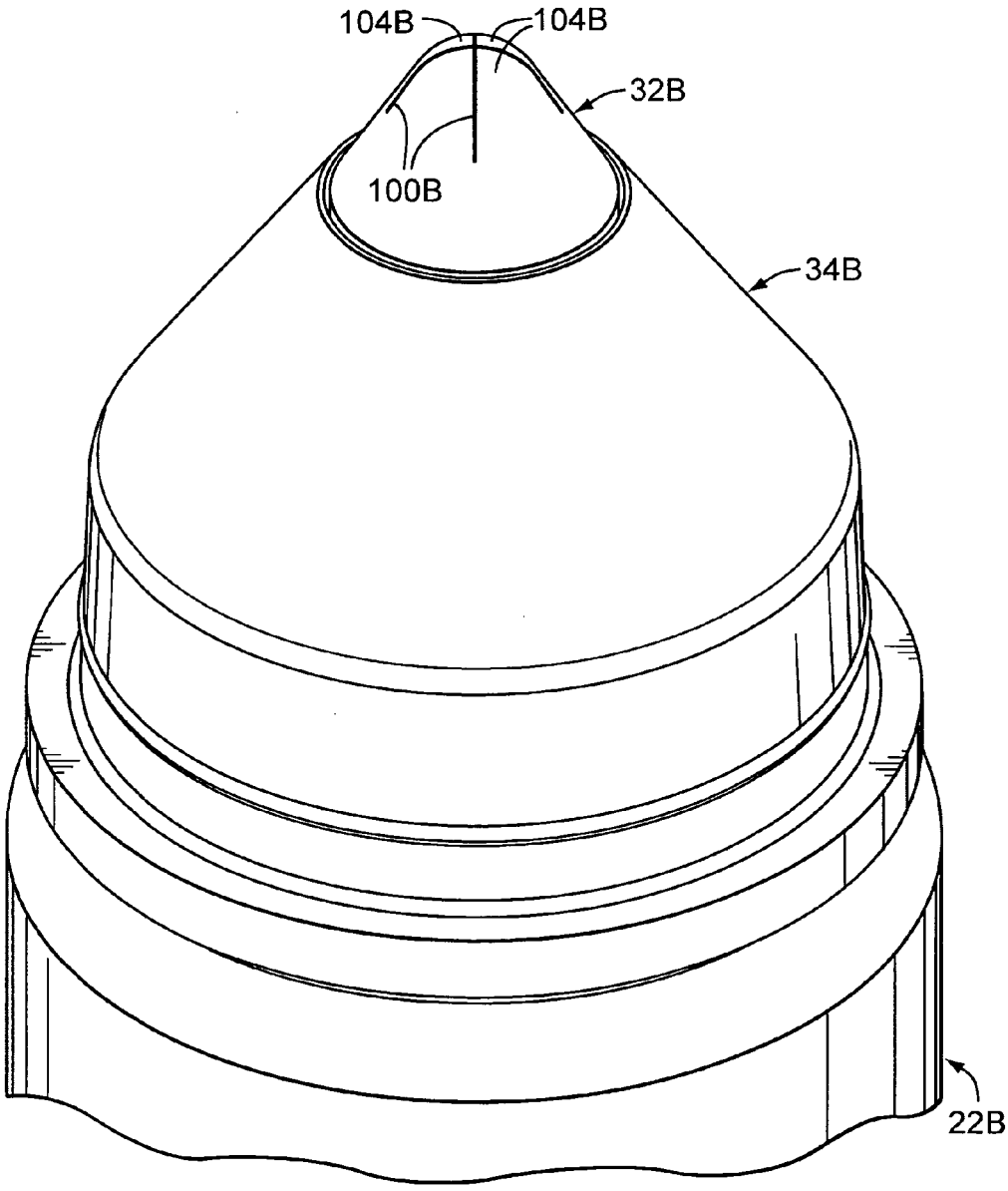
FIG. 18 is a front, isometric view of a third, or alternate, embodiment of the dispensing system of the present invention in the form of a separate dispensing closure shown in a non-dispensing configuration, after installation on a container but with the overcap removed, and from a vantage point generally above, or from the top of, the closure.
Figure 19:
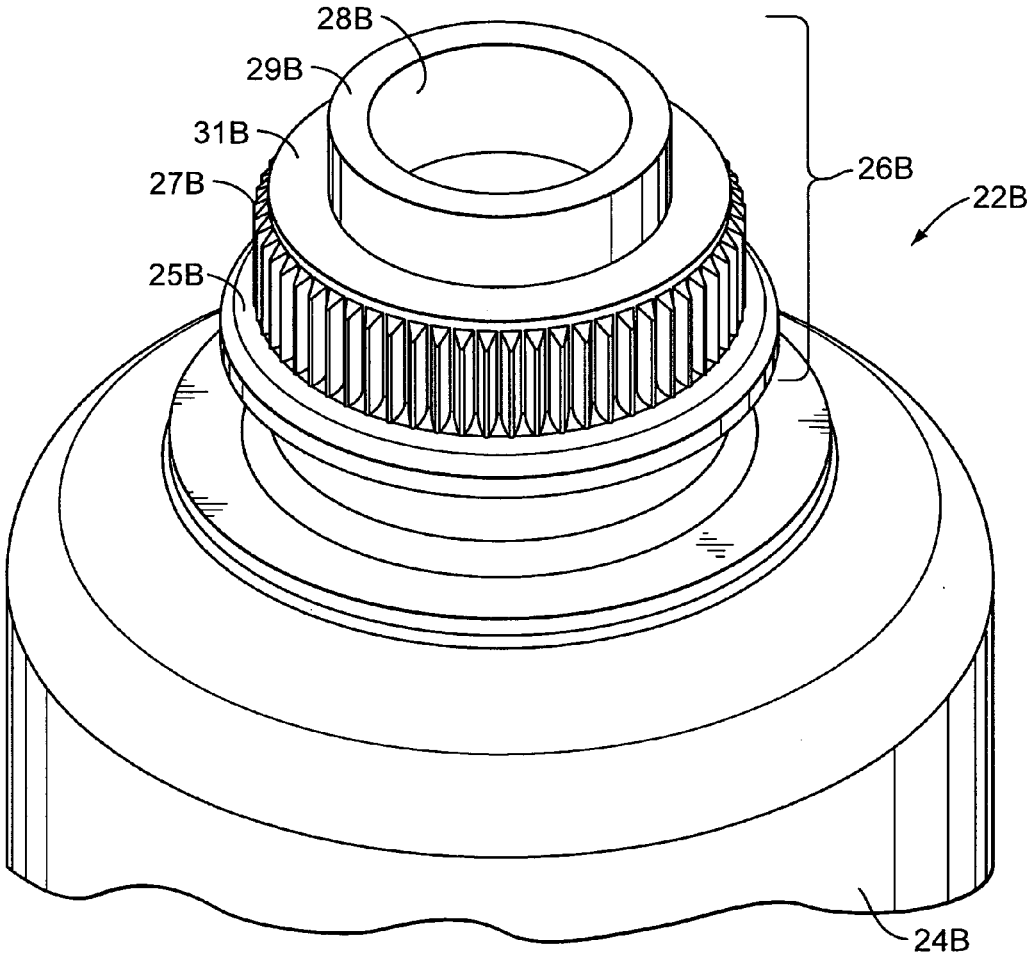
FIG. 19 is a view similar to FIG. 18, but with the third embodiment of the closure removed to reveal all the detailed structure of the top of the container which is adapted for receiving the dispensing closure.
Figure 20:
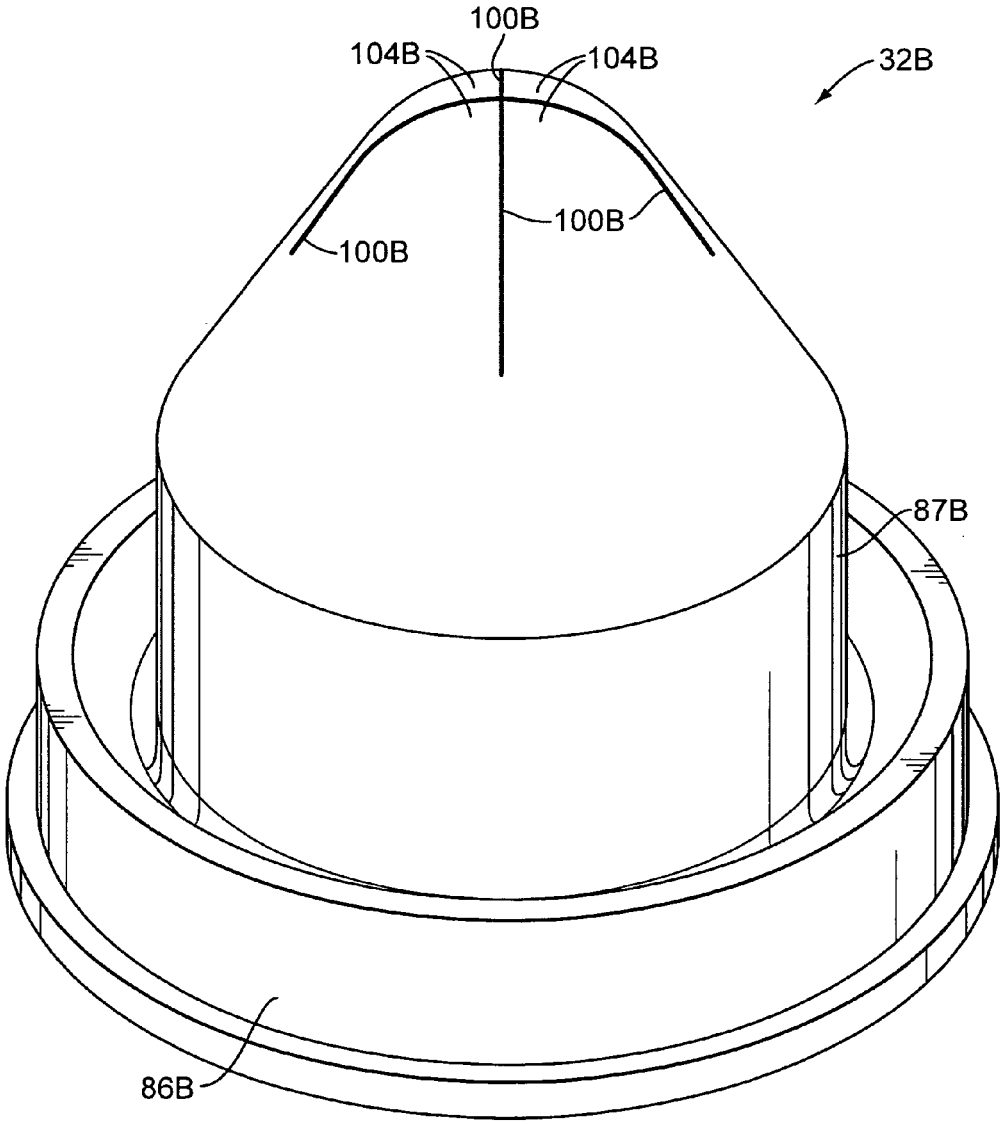
FIG. 20 is an isometric view of the valve of the third embodiment of the dispensing closure from a vantage point generally above, or from the top of, the valve.
Figure 21:
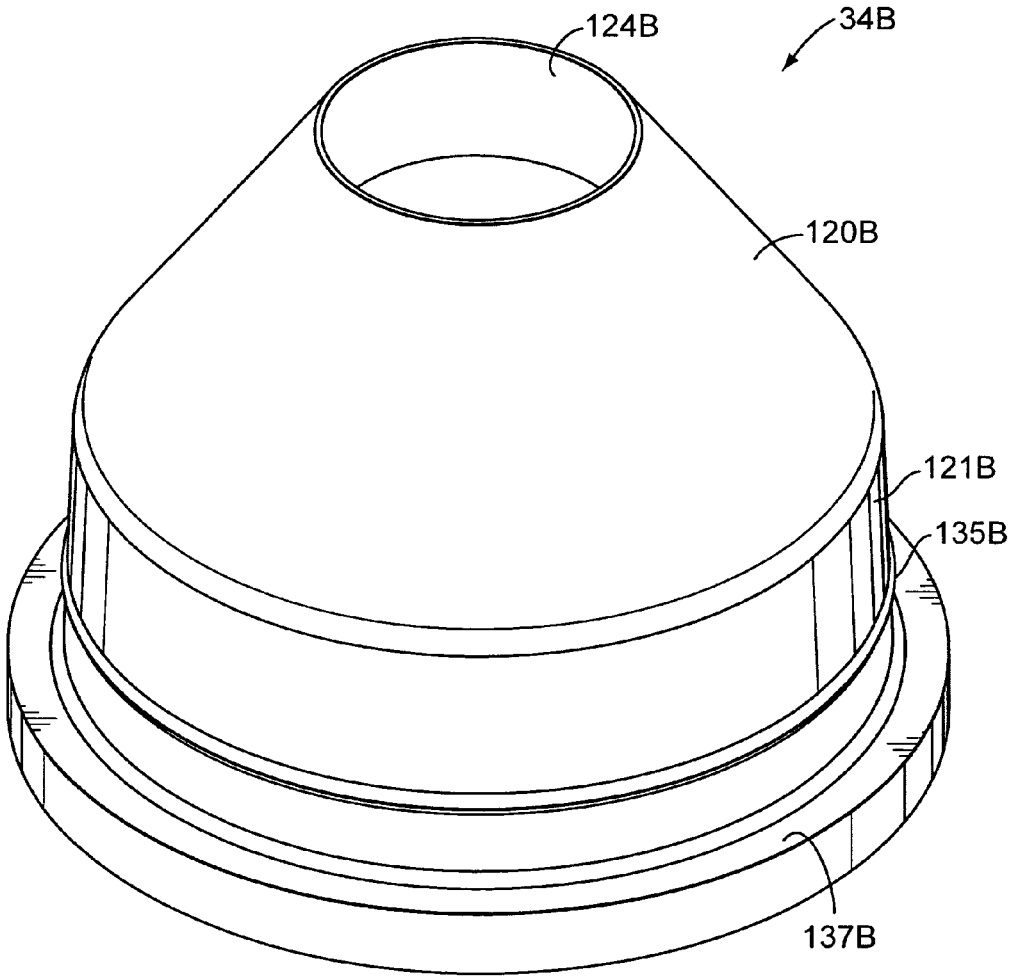
FIG. 21 is an isometric view of the clamp member of the third embodiment of the dispensing closure shown in FIG. 18 from a vantage point generally above, or from the top of, the clamp member.

An alternate, third embodiment of the dispensing system is illustrated in FIGS. 18-44 in the form of a dispensing closure for a container and is designated in some of those figures by the reference number 20B. The third embodiment is adapted for use with a container 22B (FIGS. 18 and 19). Unlike the container 22 used with the first embodiment of the invention as described above with reference to FIG. 22, the container 22B does not have a threaded neck, but instead incorporates a different, special configuration. In particular, the container 22B (FIG. 19) includes a body 24B and neck 26B having a reduced diameter collar 29B which projects upwardly from an annular shoulder 31B and which defines an opening 28B to the container interior. A flat, annular shoulder 31B extends radially around the collar 29B. The container neck 26B includes a radial flange 25B (FIGS. 19 and 28) and a plurality of vertically oriented serrations or teeth 27B which do not extend radially outwardly as far as the periphery of the flange 25B. In a presently preferred form of the third embodiment of the invention, the serrations or teeth 27B have a generally isosceles triangle shaped transverse cross section (i.e., the transverse cross section as taken on a plane passing through the serrations 27B wherein the plane is oriented generally perpendicular to a central longitudinal axis of the container neck 26B).

As with the container 22 employed with the first embodiment of the closure system described above with reference to FIGS. 1-16, the container 22B may have any suitable shape. For example, the container neck flange 25B and serrations 27B could have diameters as large as, or larger than, the diameter of the container body 24B. The container body 24B may be a rigid wall, or may be a somewhat flexible wall. The container 22B may be used to dispense a variety of materials and may be conveniently made by molding from a suitable thermoplastic material or materials in the same way as described above in detail with respect to the container 22 illustrated in FIG. 1.

Figure 27:
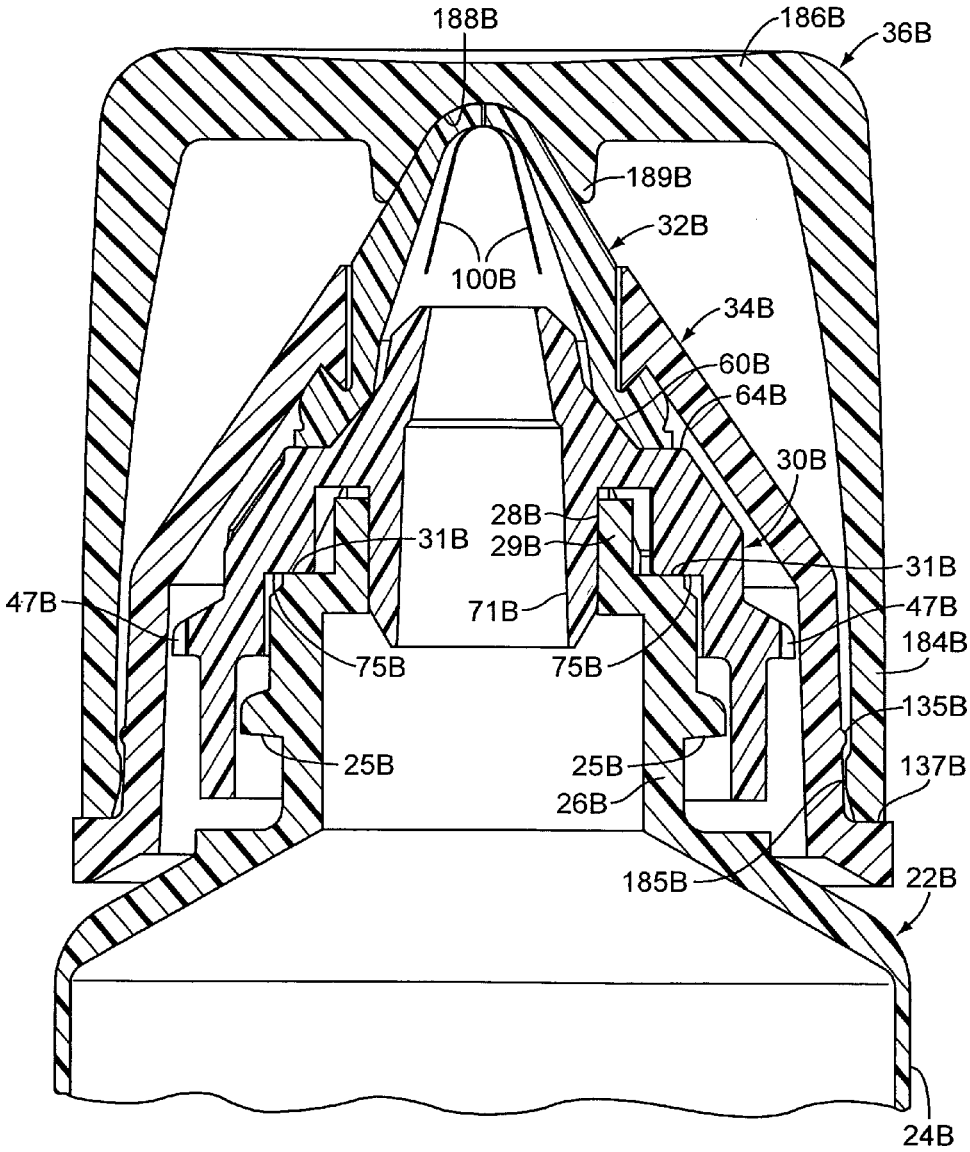
FIG. 27 is a cross-sectional view taken generally along the plane 27-27 in FIG. 26.
Figure 28:
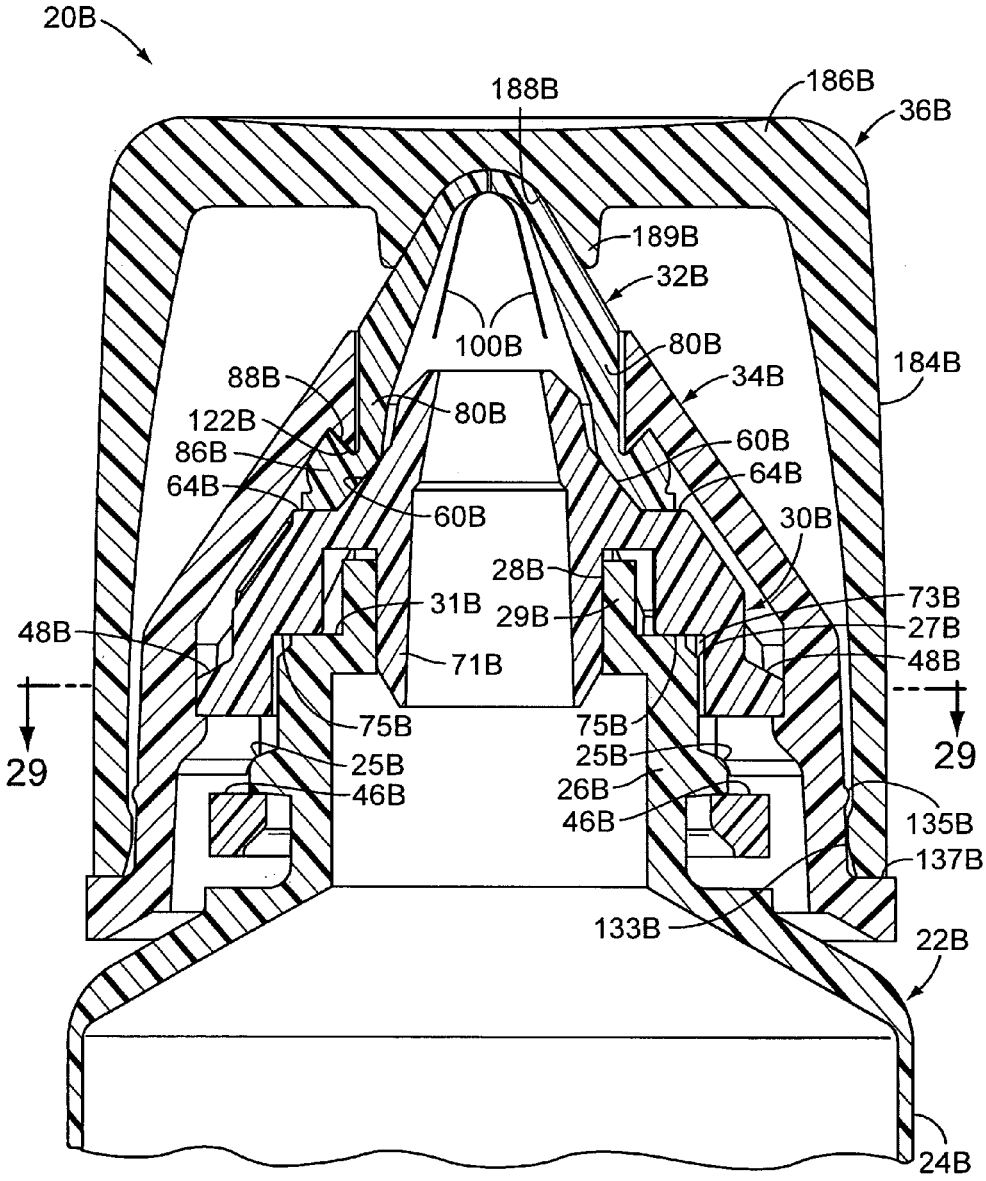
FIG. 28 is a cross-sectional view taken generally along the plane 28-28 in FIG. 26.

As can be seen in FIG. 28, the third embodiment of the dispensing closure system 20B preferably includes at least three basic components, (1) a body 30B, (2) a dispensing valve 32B which is adapted to be mounted on the body 30B, and (3) a decorative cone or clamp member 34B that retains the valve 32B on the upper part of the body 30B. In the preferred form of the third embodiment of the invention, an optional overcap 36B is provided to cover the valve 32B. The overcap 36B can be moved or removed to expose the valve 32B for dispensing, and FIG. 18 shows the system with the overcap removed. The overcap 36B is moveable between (1) a closed position over the closure clamp member 34B and valve 32B (as shown in FIGS. 27 and 28), and (2) an open or removed position (FIG. 18). The overcap 36B may be a separate component which is completely removable from the closure clamp member 34B, or the overcap 36B may be tethered to the body with a strap, or the overcap 36B may be hinged to the closure clamp member 34B so as to accommodate pivoting movement from the closed position to an open position.

Figure 22:
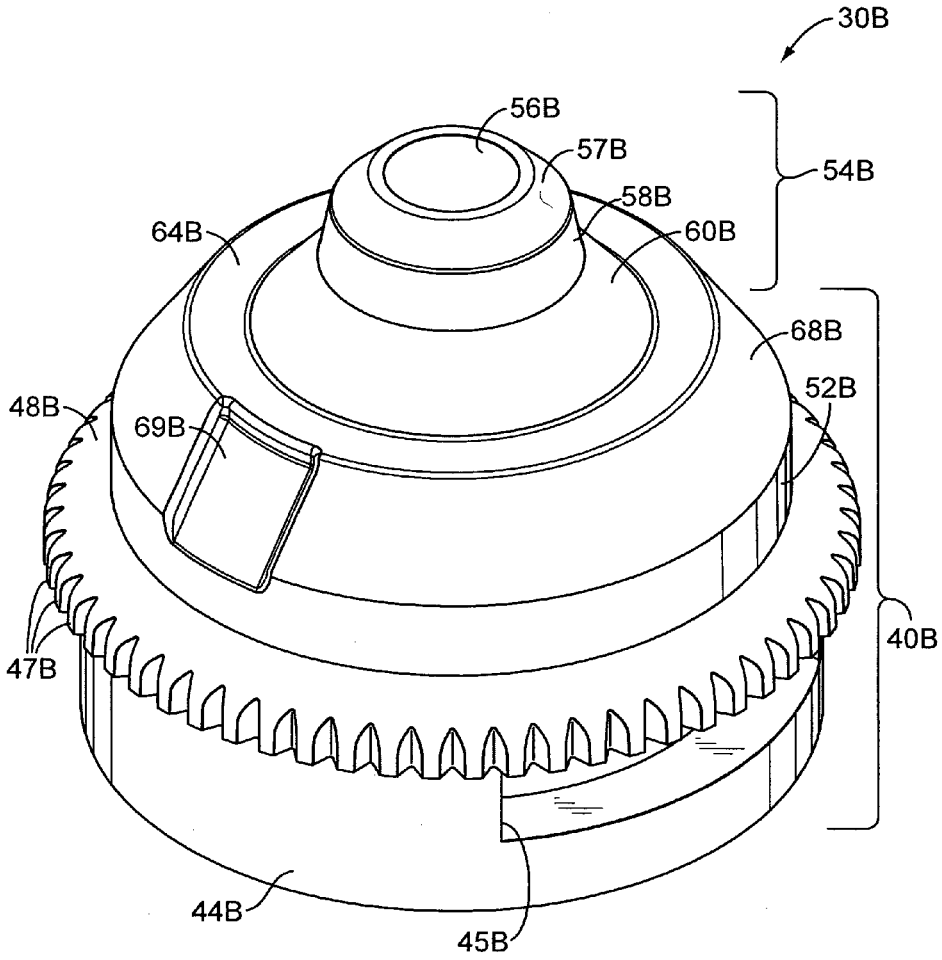
FIG. 22 is an isometric view of the closure body which is adapted to receive the valve and clamp member of the third embodiment of the dispensing closure illustrated in FIG. 18, and the isometric view of the closure body is taken from a vantage point generally above, or from the top of, the closure body.
Figure 23:
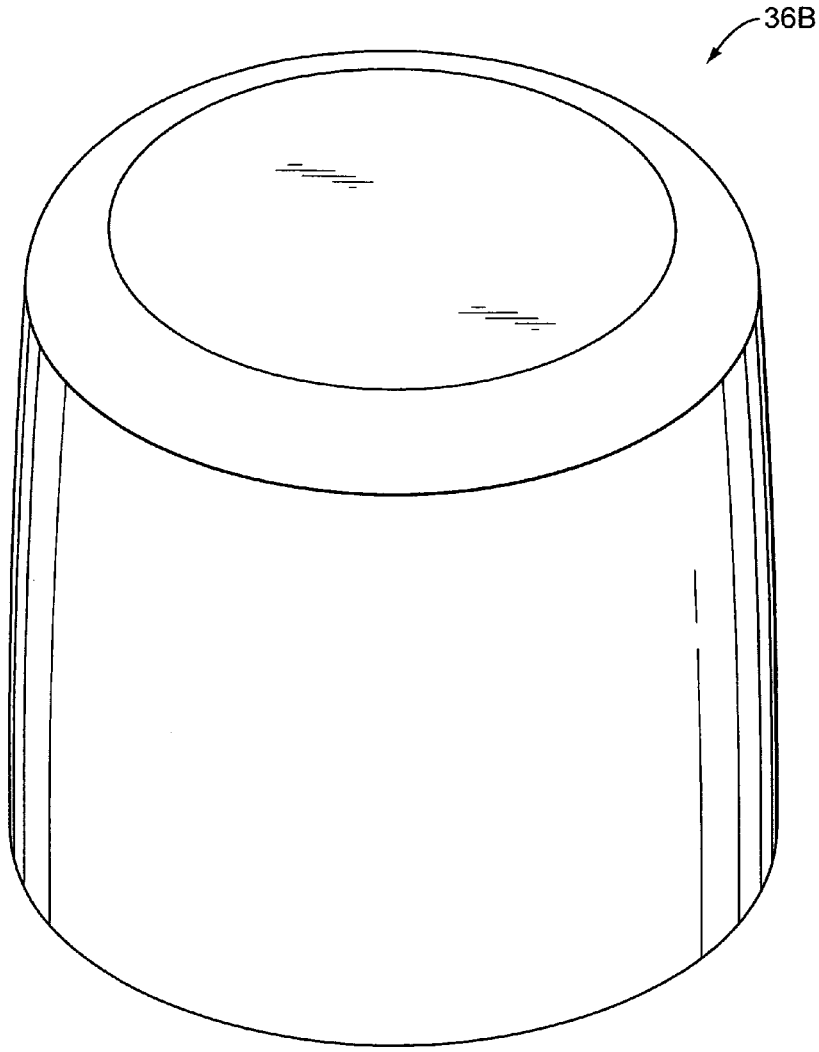
FIG. 23 is an isometric view of the overcap for the third embodiment of the closure illustrated in FIG. 18, and the isometric view of the overcap is taken from a vantage point generally above, or from the top of, the overcap.
Figure 24:
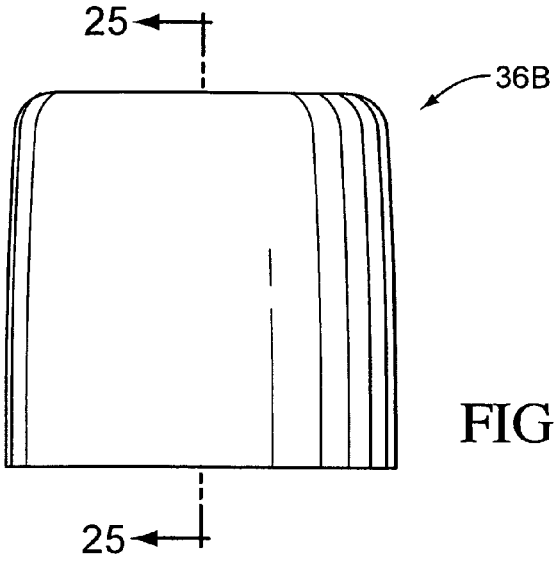
FIG. 24 is side elevation view of the overcap shown on FIG. 23.
Figure 37:
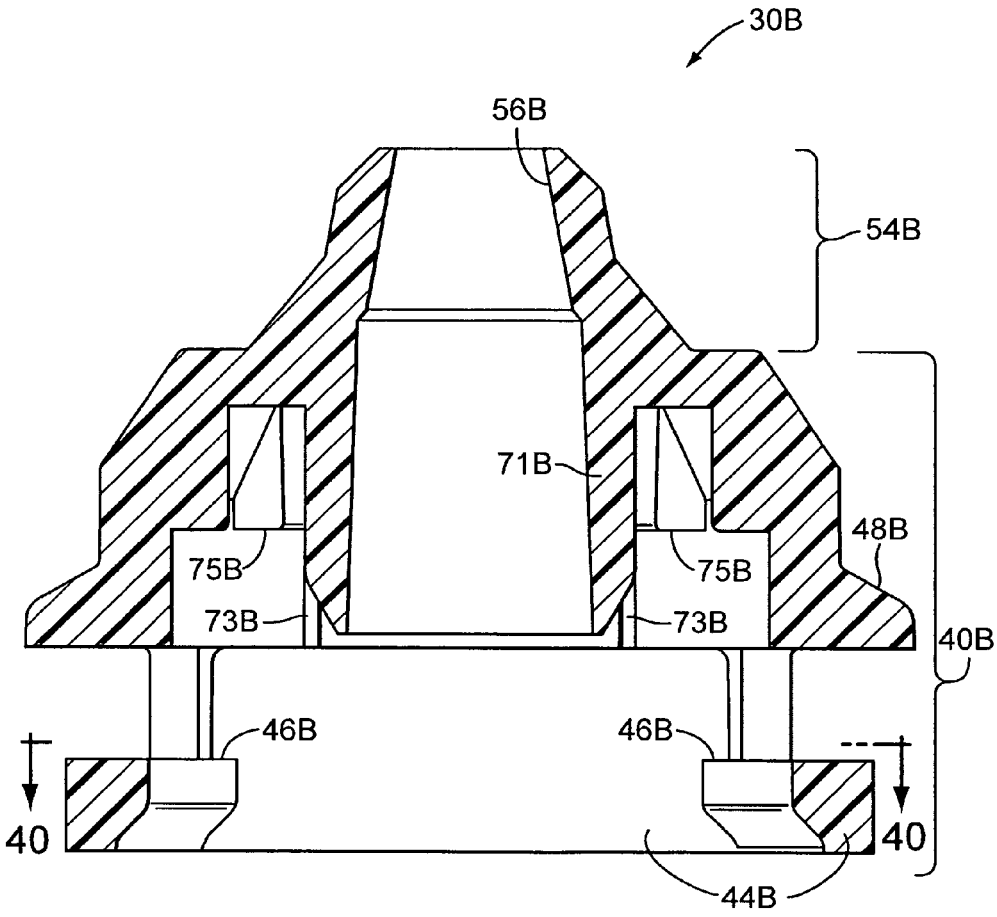
FIG. 37 is a cross-sectional view taken generally along the plane 37-37 in FIG. 36.
Figure 40:
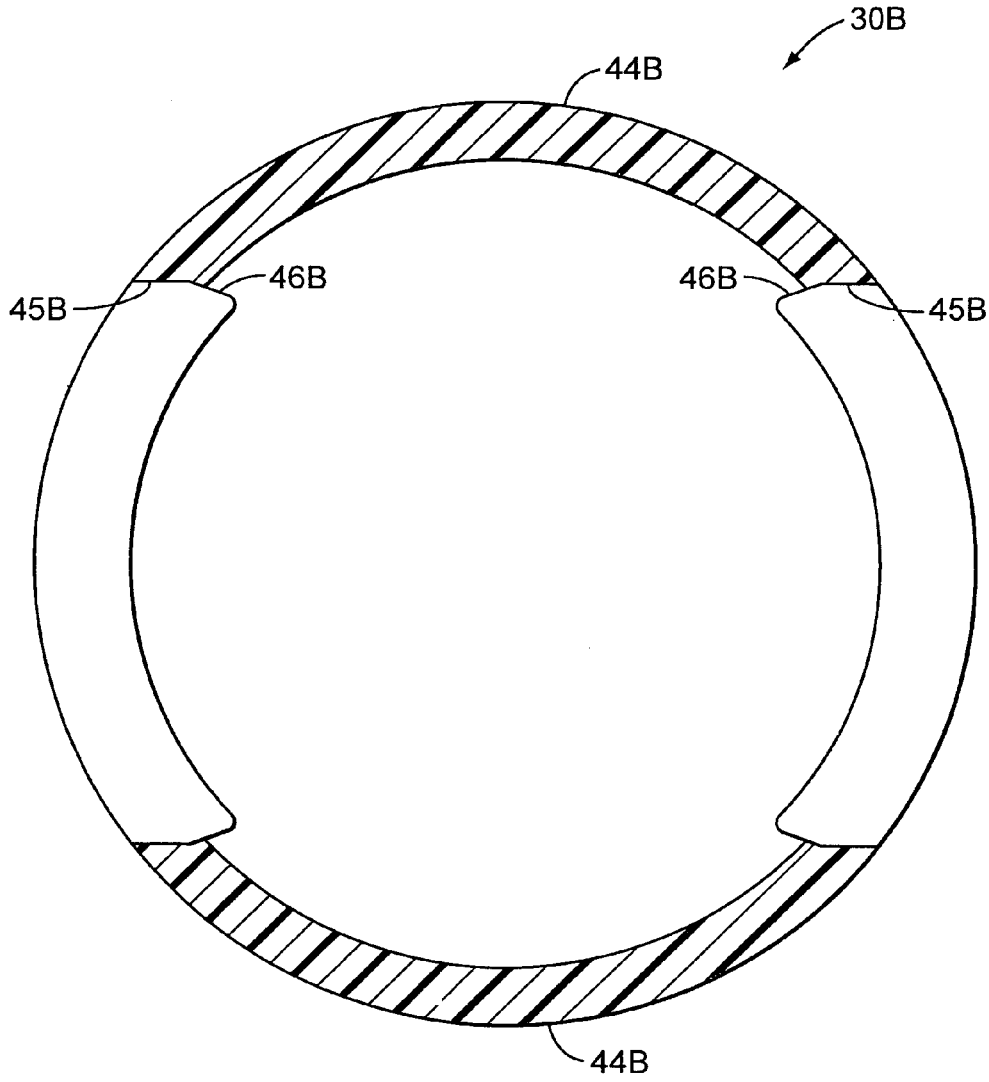
FIG. 40 is a cross-sectional view taken generally along the plane 40-40 in FIG. 37.
Figure 41:
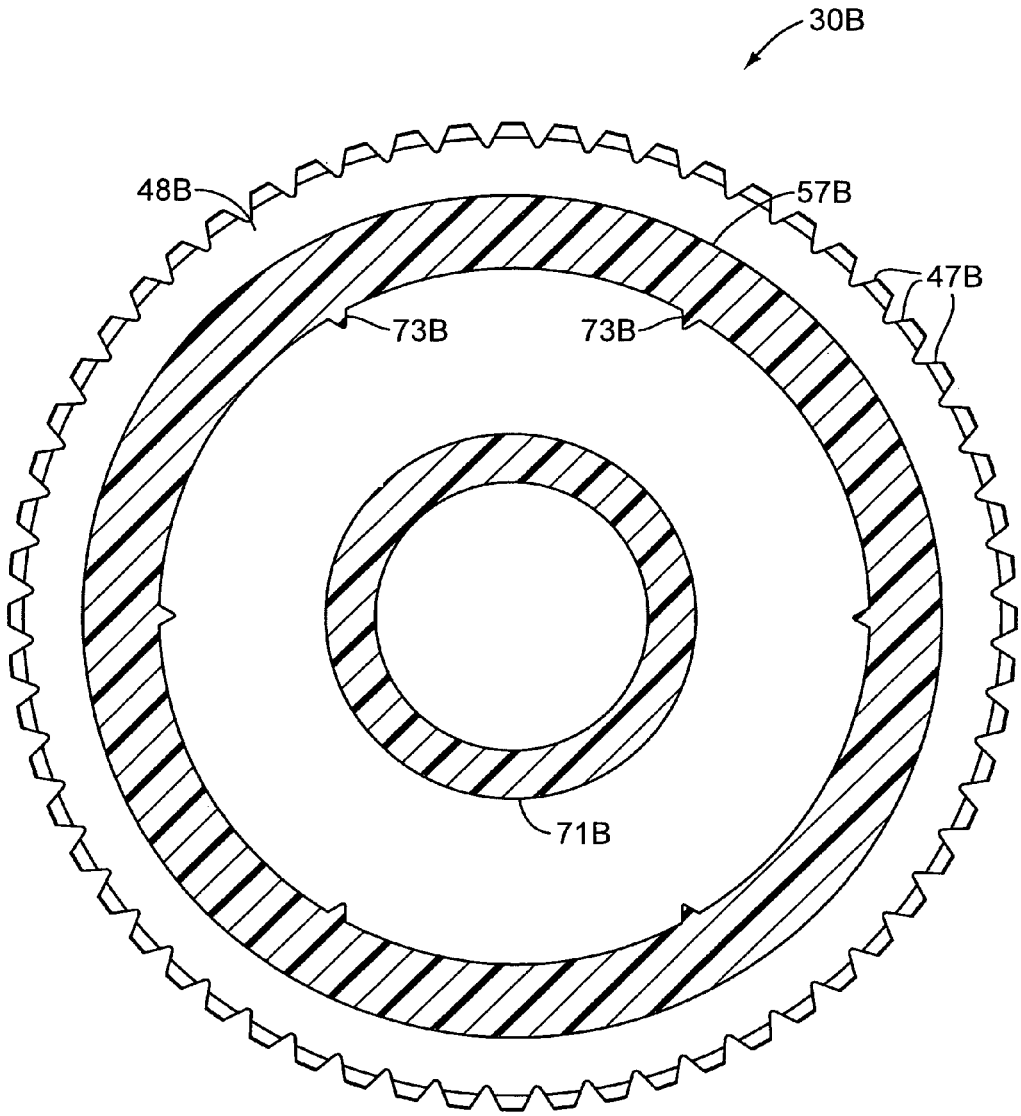
FIG. 41 is a cross-sectional view taken generally along the plane 41-41 in FIG. 38.
Figure 42:
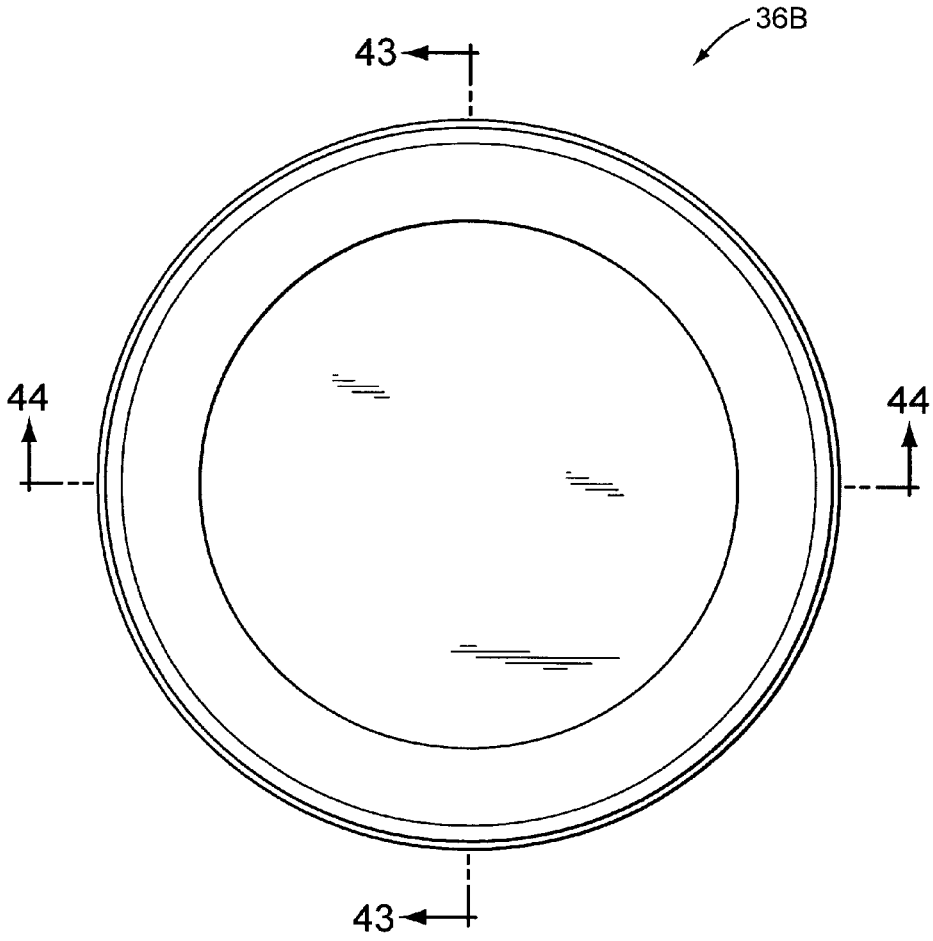
FIG. 42 is a top plan view of the third embodiment of the dispensing closure with the overcap installed, but with the dispensing closure removed from the container.

With reference to FIG. 22, the closure body 30B includes a base 40B for being mounted to, an extending from, the container 22B (when the closure body 30B is mounted on the container 22B as shown in FIG. 28). As can be seen in FIGS. 22 and 37, the closure body base 40B includes a lower wall or collar 44B which defines two arcuate slots 45B (FIG. 22 showing one slot 45B, and FIG. 40 showing both of the slots 45B). These slots 45B are provided for facilitating molding of the component. At the bottom of each slot 45B, the wall 44B extends radially inwardly (as can be seen in FIGS. 37 and 40) to define a retention shoulder or flange 46B.

Figure 38:
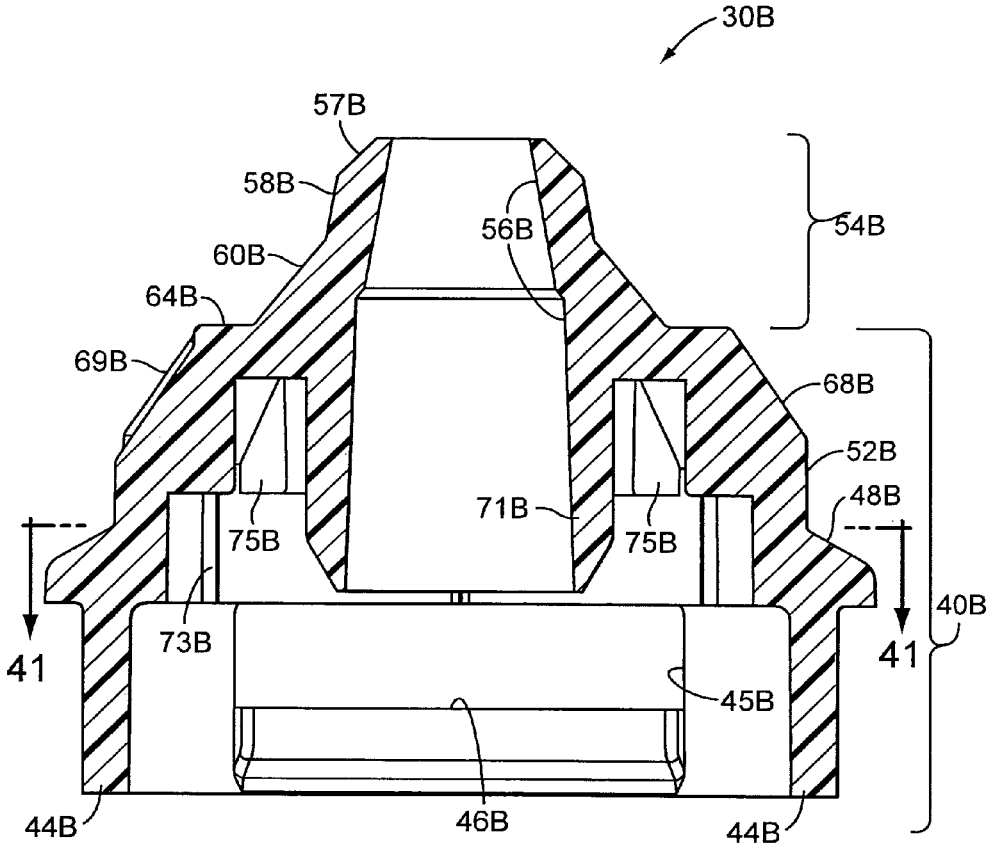
FIG. 38 is a cross-sectional view taken generally along the plane 38-38 in FIG. 36.
Figure 39:
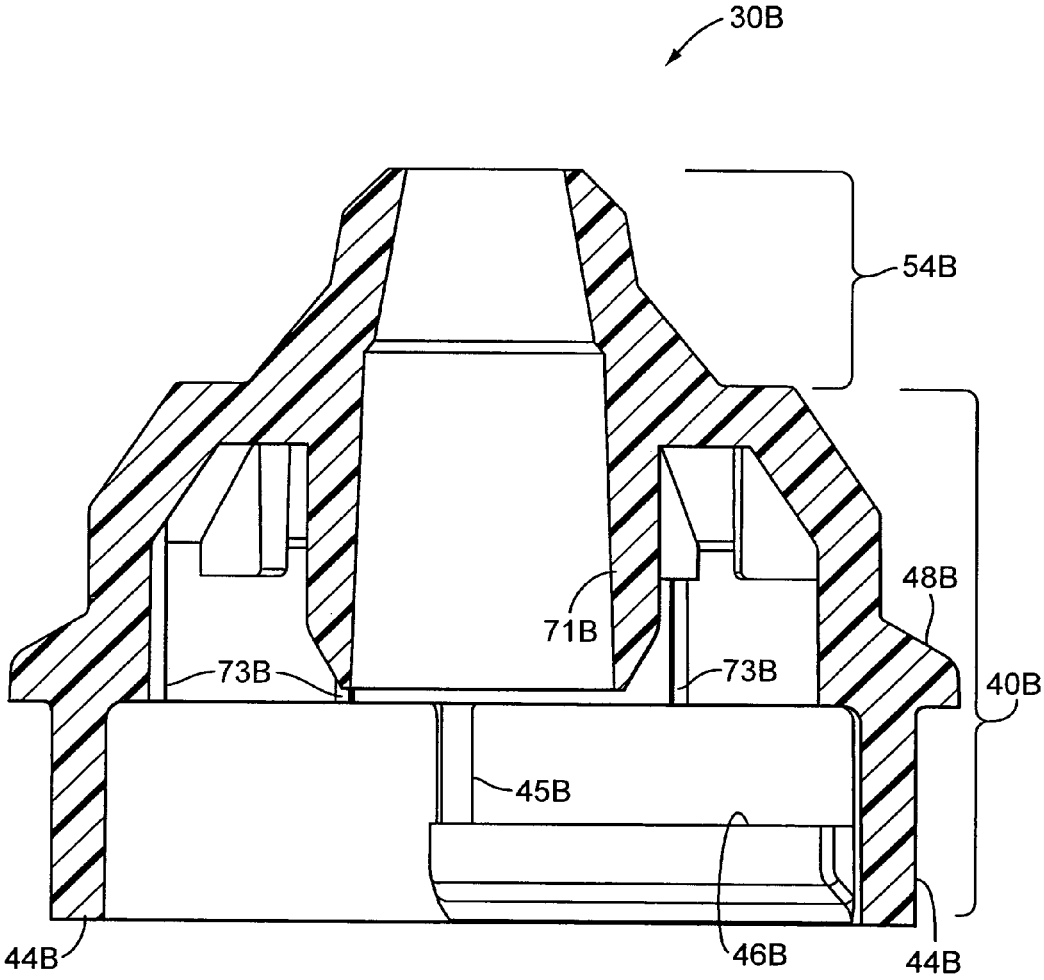
FIG. 39 is a cross-sectional view taken generally along the plane 39-39 in FIG. 36.

At the top of the closure base wall 44B there is a peripheral array of serrations or teeth 47B (FIG. 22). At the top the teeth or serrations 47B there is a radially inwardly extending, frustoconical shoulder 48B (FIGS. 22, 37, 38 and 39) which can function as a lead-in surface during assembly as described hereinafter. As can be seen in FIGS. 22 and 38, the upper portion of the closure body base 40B includes a cylindrical wall 52B and a frustoconical surface 68B extending radially inwardly from the top of the wall 52B. As can be seen in FIG. 22, the frustoconical surface 68B includes a recess 69B for containing identifying information or indicia (and such information could include the mold cavity number, for example).

As can be seen in FIGS. 22 and 38, a spout or support column 54B projects outwardly from the upper portion of the closure body base 40B. A discharge passage 56B extends through the support column 54B and through the base 40B so as to be in communication with the container interior when the closure body base 40B is installed on the container neck 26B (FIG. 27). The support column 54B includes an upper frustoconical surface 57B (FIG. 38), an intermediate frustoconical surface 58B (FIG. 38), and a lower frustoconical surface 60B. At the bottom of the lower frustoconical surface 60B is an annular shoulder 64B against which the bottom end of the dispensing valve 32B can be disposed (FIG. 28). Projecting downwardly from the inside of the support column 54B is an internal conduit 71B (FIG. 38) for being received in the mouth or opening 28B of the container neck as shown in FIG. 28.

In the preferred form of the third embodiment of the dispensing system 20B illustrated in FIGS. 18-44, the conduit or tube 71B (FIGS. 27 and 28) provides an effective seal with the container 22B. If desired, other suitable seal structures could be provided instead. Such a seal structure could be a "crab's claw" seal, a flat seal, a "V" seal, or some other such conventional or special seal, depending upon the particular application and depending upon whether or not a liner is employed.

As can be seen in FIGS. 37, 38, 39, and 41, the interior of the closure body base 40B includes a plurality of circumferentially spaced anti-rotation teeth or ribs 73B. As can been seen in FIGS. 35 and 38, the interior of the closure body base 40B also includes a plurality of circumferentially spaced inner abutment ribs 75B located at the top of the anti-rotation ribs 73B. As can be seen in FIGS. 27 and 28, the abutment ribs 75B engage, and seat upon, the annular shoulder 31B which surrounds the container spout 29B. The abutment ribs 75B thus locate the closure body 30B vertically at the desired location on top of the container 22B.

Figure 29:
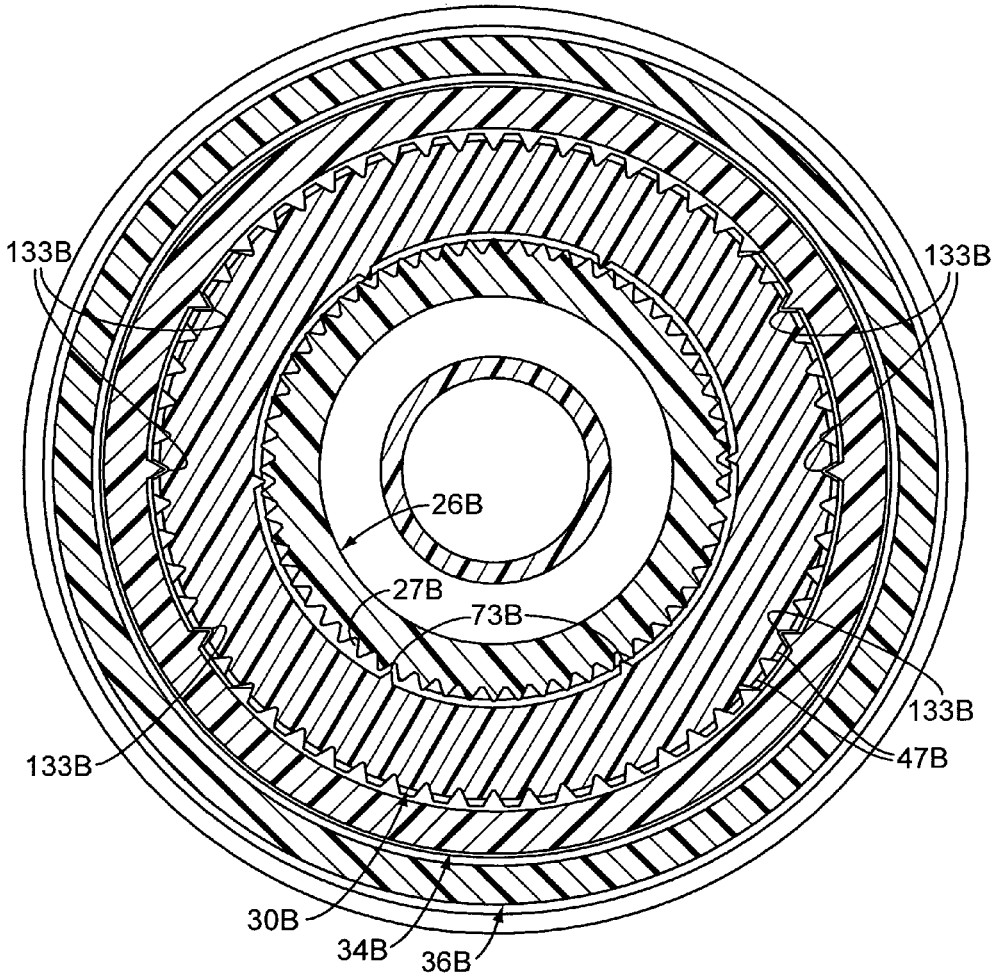
FIG. 29 is a cross-sectional view taken generally along the plane 29-29 in FIG. 28.

As can be seen in FIGS. 28 and 29, when the closure body 30B is mounted on the top of the neck 26B of the container 22B, the inwardly projecting teeth or anti-rotation ribs 73B engage the teeth or serrations 27B on the container neck 26B. This prevents the relative rotation between the closure body 30B and the container 22B.

Figure 43:
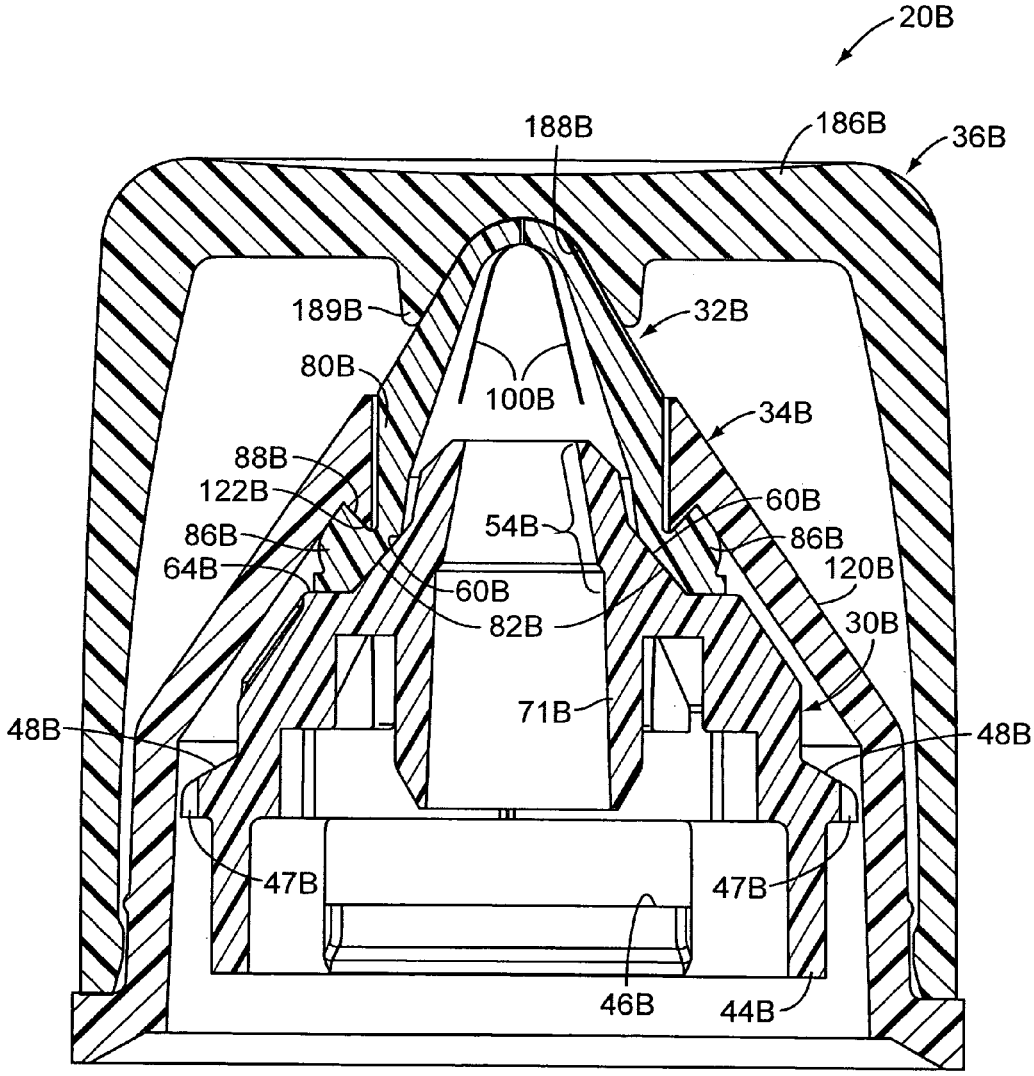
FIG. 43 is a cross-sectional view taken generally along the plane 43-43 in FIG. 42.
Figure 44:
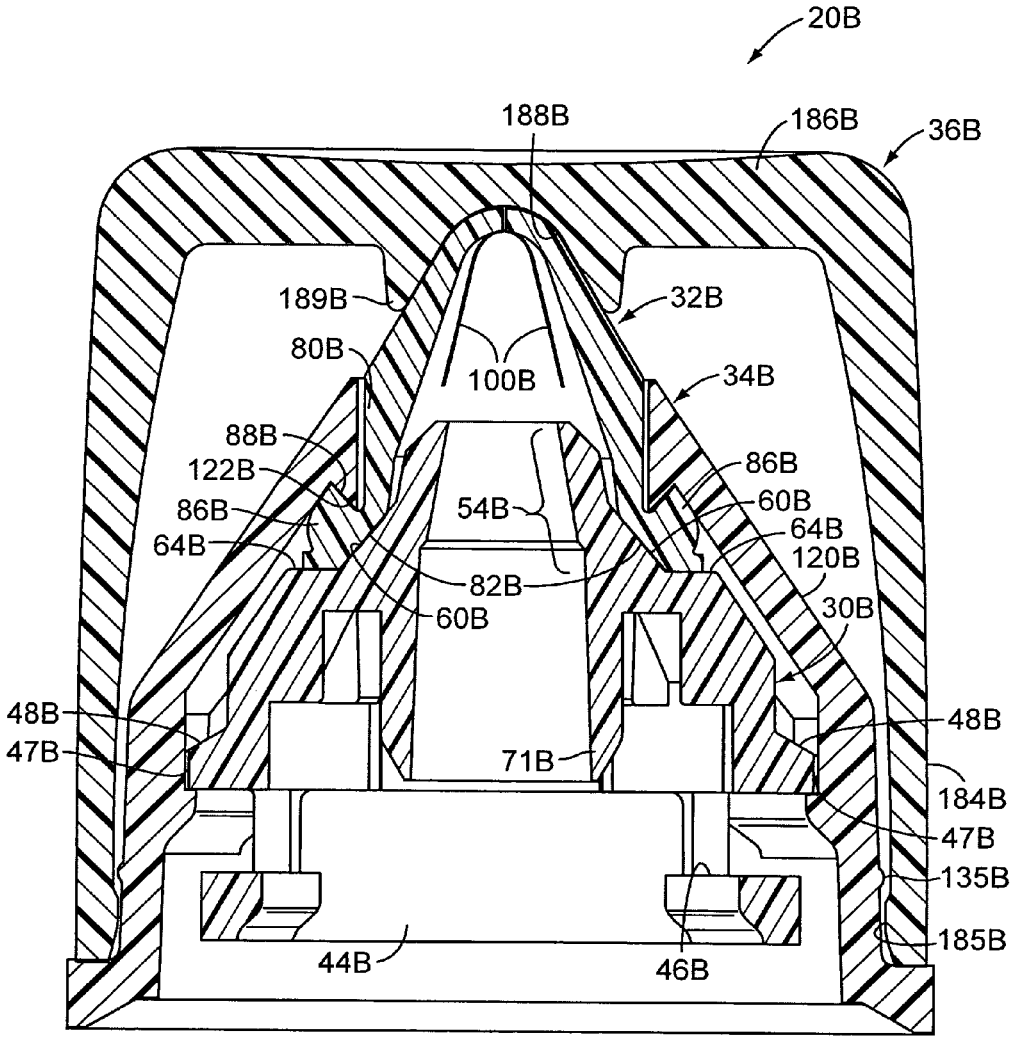
FIG. 44 is a cross-sectional view taken generally along the plane 44-44 in FIG. 42.

The valve 32B is adapted to be mounted on the closure body spout or support column 54B as shown in FIGS. 43 and 44. As with the first embodiment valve 32 described above with reference to the first embodiment of the system illustrated in FIGS. 1-16, the third embodiment valve 32B is a pressure-actuatable, flexible, slit-type valve which is held on the outside of the spout or support column 54B by means of the clamp member 34B as described in detail hereinafter. The third embodiment valve 32B is preferably molded as a unitary structure from material which is flexible, pliable, elastic, and resilient. The valve 32B can be molded from the same materials as the first embodiment valve 32 described above.

Figure 30:
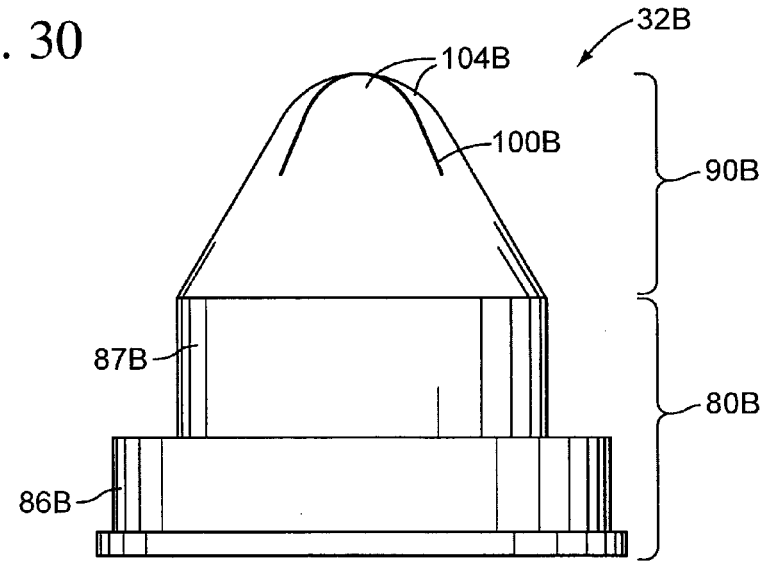
FIG. 30 is a side elevational view of the third embodiment valve shown in FIG. 20.
Figure 31:
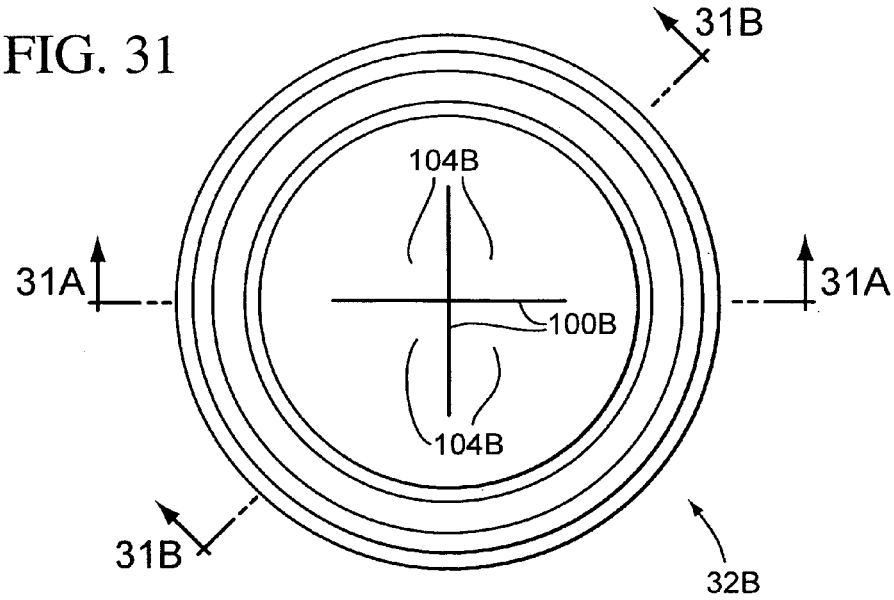
FIG. 31 is a top plan view of the third embodiment valve.
Figure 31A:
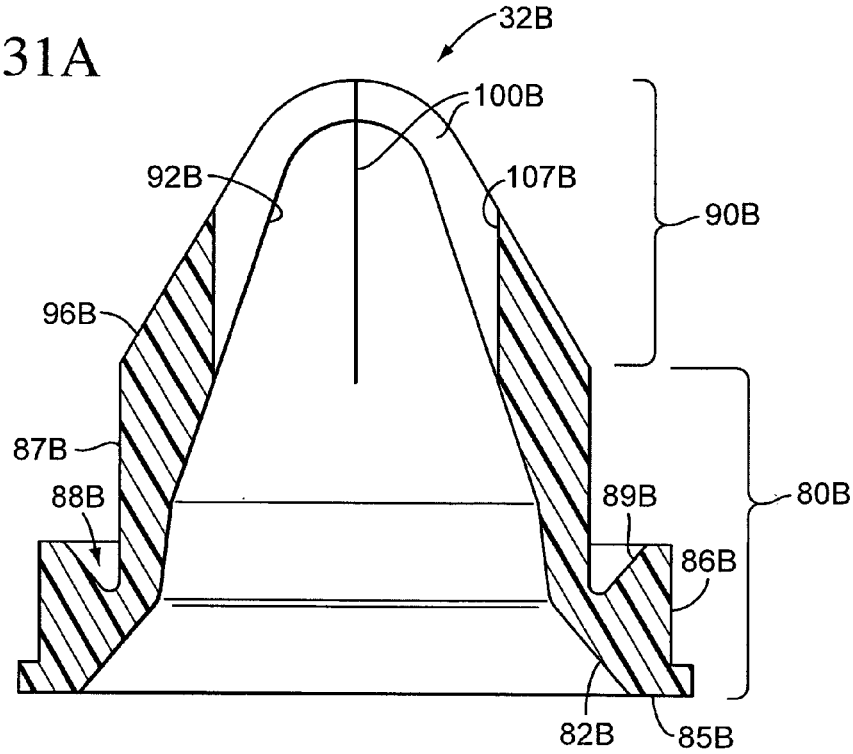
FIG. 31A is a cross-sectional view taken generally along the plane 31A-31A in FIG. 31.
Figure 31B:
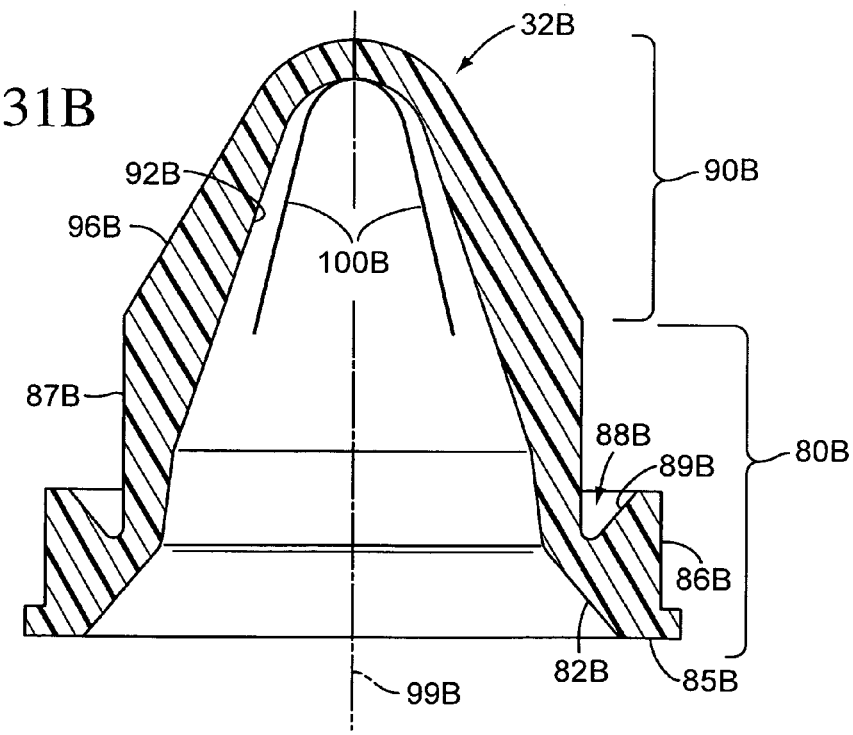
FIG. 31B is a cross-sectional view taken generally along the plane 31B-31B in FIG. 31.

The valve 32B is similar to, and includes the unique features of, the first embodiment valve 32 described above with reference to the first embodiment of the system illustrated in FIGS. 1-16. In particular, the third embodiment valve 32B includes a base 80B (FIGS. 30, 31A and 31B). The base 80B functions as a peripheral mounting skirt 80B for being clamped by the clamp member 32B against the closure body 30B as illustrated in FIGS. 43 and 44. When properly clamped, the valve 32B is sealingly engaged with the frustoconical surface 60B of the closure body 30B as illustrated in FIGS. 43 and 44. At least part of the valve skirt 80B defines an interior sealing surface 82B (FIGS. 31A and 3B). Preferably, the interior sealing surface 82B has a frustoconical configuration to matingly engage, and seal against, the preferred frustoconical form of the exterior surface 60B of the closure body support column 54B as can be seen in FIG. 43.

The valve base or skirt 80B also defines an outwardly opening annular groove 88B (FIGS. 31A and 31B), and one lower side surface of the groove 88B is defined by a peripheral, annular shoulder 89B (FIGS. 31A and 31B) which has a frustoconical surface. The frustoconical surface of the shoulder 89B diverges relative to the frustoconical interior sealing surface 82B as can be seen in FIG. 31A. The frustoconical surface of the shoulder 89B and the frustoconical interior sealing surface 82B may be characterized as defining exterior surface portions of an annular mounting flange 86B (FIGS. 31A and 31B). The flange 86B also preferably has an annular, flat bottom surface 85B (FIGS. 31A and 31B).

As can be seen in FIGS. 31A and 31B, the valve 32B has a generally cylindrical surface 87B extending upwardly from the bottom of the annular groove 88B. The top of the cylindrical surface 87B terminates at, and defines, the upper end of the valve skirt or base 80B.

As can be seen in FIGS. 30, 31A, and 31B, the valve 32B includes a flexible, outwardly extending, narrowing, dispensing head 90B. The head 90B extends outwardly from the top of the base or skirt 80B to a dispensing tip. The head 90B extends over the interior volume defined within the valve 32B. The head 90B is generally convex (and, in the preferred embodiment is dome shaped) as viewed from the exterior of the valve 32B relative to the interior volume (see FIGS. 31A and 31B). The valve head 90B has an interior surface 92B (FIG. 31B) that interfaces with the product in the container 22B. In the preferred the preferred form of the valve 32B, the interior surface 92B tapers or slants outwardly and is preferably frustoconical below the curved inside surface of the valve head tip. However, the surface 92B as viewed in FIG. 31B need not have a uniform or constant taper or slant, and could be curved.

As shown in FIG. 31B, the valve head 90B has an exterior surface 96B which interfaces with the ambient environment. The exterior surface 96B narrows, converges, or tapers, but such a narrowing configuration need not be uniform or even continuous. The surface 96B as viewed in FIG. 31B could be slightly curved. However, according to one preferred aspect of the invention, the valve head 90B has a continuous taper or narrowing at least over most of its height so as to cooperate with, and follow, the general tapering configuration of the clamp member 34B. The distal end or tip of the valve 32A is smaller in cross-sectional size than the skirt flange 86B. In the preferred form of the valve 32B, the exterior surface 96B is frustoconical between the valve head curved tip and the upper end of the skirt 80B. In the illustrated preferred embodiment, the region defined by the exterior surface 96B and interior surface 92B is a wall having a tapering configuration below the valve tip.

In the illustrated preferred form of valve 32B, the valve 32 B has a generally circular configuration about a central longitudinal axis 99B extending through the valve 32B (FIG. 31B). The head 90B of the valve 32B has a dispensing orifice. In the preferred embodiment, the orifice is defined by one or more slits 100B (FIG. 31B). Preferably, there are two or more slits 100B radiating laterally from the longitudinal axis 99B. More preferably, there are four slits 100B that radiate from the axis 99B. The four radiating slits 100B may be alternatively characterized as two intersecting cross slits 100B. A lesser or greater number of slits 100B could be used. The slits 100B preferably extend transversely through head portion 90B between the exterior surface 96B and the interior surface 92B.

In the illustrated preferred form of the valve 32B, the slits 100B extend laterally from a common origin on the longitudinal axis 99B to define four flaps or petals 104B (FIG. 31) which can flex outwardly to selectively permit the flow of product from the container 22B through the valve 32B. Each slit 100B terminates in a radially outer end that is also the bottom end of the slit. In the illustrated preferred form of the valve, the slits 100B are of equal length, although the slits 100B could be of unequal length.

In the preferred form of the valve, each slit 100B is planar, and the plane of each slit 100B contains the central, longitudinal axis 99B of the valve 32B. Preferably, the slits 100B diverge from an origin on the longitudinal axis 99B and define equal size angles between each pair of adjacent slits 100B so that the flaps 104B are of equal size. Preferably, the four slits 100B diverge at 90 degree angles to define two mutually perpendicular, intersecting, longer slits. Preferably, the slits 100B are formed so that the opposing side faces of adjacent valve flaps 104B closely seal against one another when the dispensing orifice is in its normal, fully closed position. The length and location of the slits 100B can be adjusted to vary the predetermined opening pressure of the valve 32B, as well as other dispensing characteristics.

The tip portion or tip of the valve head 90B includes at least the upper end portions of the slits 100B. In the preferred illustrated form of the valve head 90B, the tip portion or tip is defined as a uniform wall thickness region above (outwardly from) the tapering wall thickness between the exterior surface 96B and the interior surface 92.

In the preferred form of the valve 32B as shown in FIG. 31A, the slits 100B each extends downwardly from the tip portion into the tapering wall below the tip portion to define an outside vertical lateral edge 107B parallel to the longitudinal axis 99B.

In the presently preferred form of the valve 32B illustrated in FIGS. 20, 30, 31, 31A and 31B, a typical size valve 32B molded from silicone has four slits 100B. It is to be understood that the valve dispensing orifice may be defined by structures other than the illustrated slits 100B. If the orifice is defined by slits, then the slits may assume many different shapes, sizes and/or configurations in accordance with those dispensing characteristics desired. For example, the orifice may also include five or more slits, particularly when larger or wider streams are desired, and/or the product is a particulate material or a liquid containing aggregates.

The dispensing valve 32B is preferably configured for use in conjunction with a particular container, and a specific type of product, so as to achieve the exact dispensing characteristics desired. For example, the viscosity and density of the fluid product can be factors in designing the specific configuration of the valve 32B for liquids, as is the shape, size, and strength of the container. The rigidity and durometer of the valve material, and size and shape of the valve head 90B, are also important in achieving the desired dispensing characteristics, and can be matched with both the container and the material to be dispensed therefrom.

The valve 32B is especially suitable for dispensing flowable products, such as liquids or even gases, powders, particulates, or granular material, as well as suspensions of solid particles in a liquid. The valve 32B is particularly suitable for dispensing shampoos, liquid toothpaste, thin oils, thick lotions, water, and the like.

It is to be understood that, according to the present invention, portions of the valve 32B may assume different shapes and sizes, particularly in accommodating the type of container and product to be dispensed therefrom. The predetermined opening pressure of the valve 32B may be varied widely in accordance with those dispensing criteria desired for a particular product. Flow characteristics of the dispensed product can also be adjusted substantially, such as for relatively wide column-like streams, thin needle-like streams, multiple streams, variations thereof, and the like.

In one presently preferred form of the second embodiment valve 32B illustrated in FIGS. 30, 31, 31A and 31B, many of the dimensions of the valve head 90B are the same as the corresponding dimensions of the first embodiment valve 32 described above with reference to FIG. 12 for the dimensions A, B, C, D, E, F, G, $T_1$, $T_2$, X, Y, and Z. In applying the first valve embodiment FIG. 12 dimensions to the alternate embodiment shown in FIG. 31A, the dimensions F and G as applied to FIG. 31A are each identical to dimension E, and dimension $T_3$ is identical to dimension $T_2$.

As viewed in the vertical cross section shown in FIG. 31A, the tip portion at the top of the preferred form of the valve head 90B has a circular arc interior surface (i.e., partially spherical) and a circular arc exterior surface (i.e., partially spherical), and the angle of the circular arc is 136 degrees. In this preferred configuration, the wall of the tip is an arcuate (i.e., partially spherical) wall having a uniform thickness equal to the smallest thickness of the tapering wall extending downwardly from the tip between the surfaces 96B and 92B.

Preferably, the wall thickness of the illustrated preferred form of the valve head 90B continuously decreases over (along) most of the height from the top of the base or skirt 80B at least to the valve tip portion. The wall thickness of the valve tip portion is preferably equal to, or less than, the smallest thickness of such a tapering wall.

Further, for one particular preferred embodiment of the valve head 90B, the overall maximum external diameter of the valve head 90B at the top of the base or skirt 80B is about 0.250 inch. The radius of the exterior surface of the valve head tip is 0.067 inch, and the concentric interior surface at the tip has a radius of 0.047 inch.

According to presently preferred forms of the valve 32B, the width A of the two aligned slits 100B across the valve diameter (corresponding to dimension "A" in FIG. 12) is preferably in the range of between about 30% and about 80B % of the maximum inside diameter of the valve head interior surface 92B (as measured at the bottom of the slits 100B). Also, preferably, the thickness of the valve head 90B at the end of the tip (where all four slits 100BB meet) is between about 30% and about 80% of the maximum thickness of the wall of the valve head 90B at the top of the base or skirt 80B. Preferably, the height of the valve head 90B from the top of the base or skirt 80B to the top of the slits at the exterior of the tip of the valve head 90B is between about 30% and about 180B % of the maximum inside diameter of the valve head interior surface 92B at the bottom of the slits 100B.

Operation of the valve 32B is the same as described for first embodiment valve 32 illustrated in FIGS. 11 and 12.

The illustrated preferred form of the valve 32B provides an improved dispensing valve with the capability for allowing the user to readily view, target, and control the dispensing of the fluent material from the valve. The valve 32B can function to dispense a product accurately while minimizing the likelihood of accidental, premature, or undesired product discharge, and while providing good product cut-off at the termination of dispensing with little or no mess of product left on the exterior of the valve (or package containing the valve). The closed valve can minimize, or at least reduce, the likelihood either of the product drying out in the package or being contaminated.

The illustrated preferred form of the valve 32B has a sleek, directional appearance. Because the valve head tapers (becomes narrow) toward the end of the tip portion (where the intersecting slits 100B meet), and because the wall thickness is thinner in the tip portion, the valve has less resistance to opening than some other valve configurations that lack such a configuration. Thus, the valve 32B can be easier to open (e.g., requiring less squeezing pressure on a container to which the valve is mounted). Because the wall of the valve 32B is increasingly thicker in the direction away from the dispensing tip portion, the valve 32B can exhibit a desired, sufficient re-closing strength to close the petals 104B in response to a predetermined decrease in differential pressure across the open valve petals.

As can be seen in FIG. 27, the valve 32B is preferably installed so that (1) the annular interior sealing surface 82B of the valve 32B is seated in engagement with the annular surface 64B of the body 30B, and (2) the valve flange bottom surface 85B is seated on the annular shoulder 64B of the body 30B. The valve 32B is held tightly engaged with the body spout or support column 54B by the clamp member 34B. The clamp member 34B functions to retain the valve 32B in the proper position and also provides a decorative or aesthetic function of covering a lower portion of the valve 32B and a lower portion of the body 30B.

Figure 32:
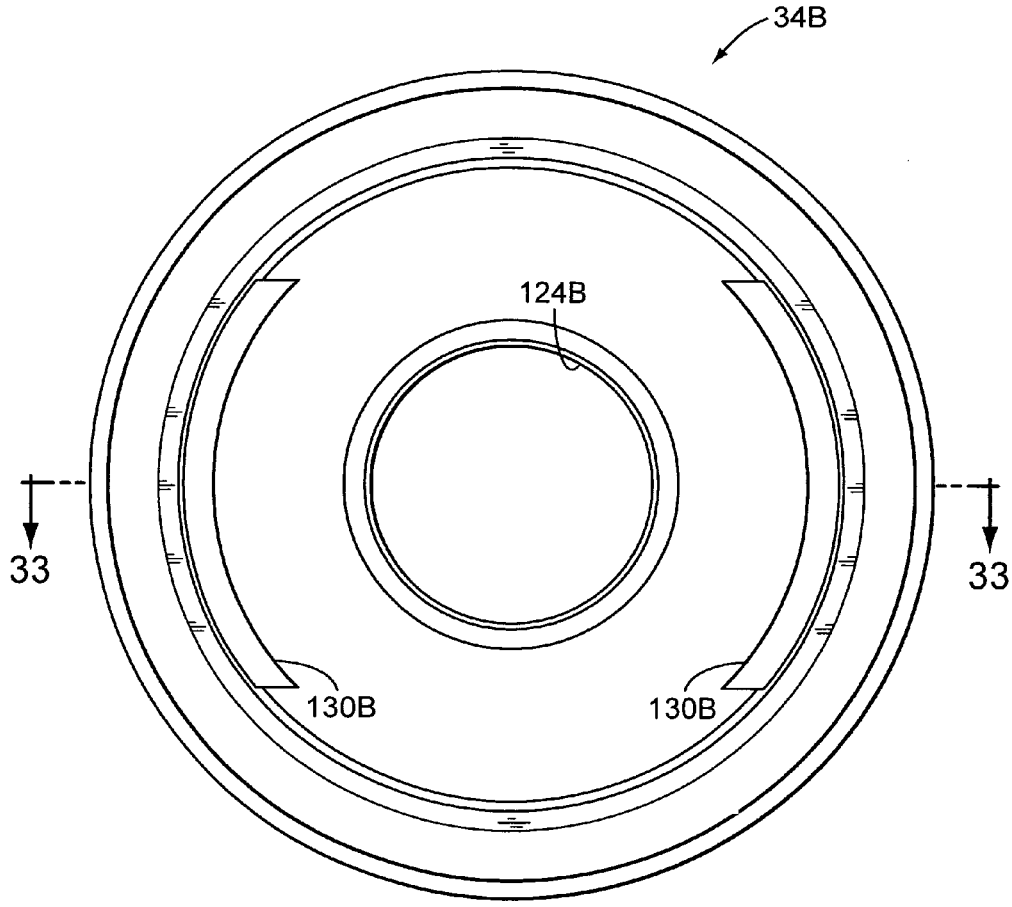
FIG. 32 is a bottom plan view of the clamp member shown in FIG. 21.
Figure 33:
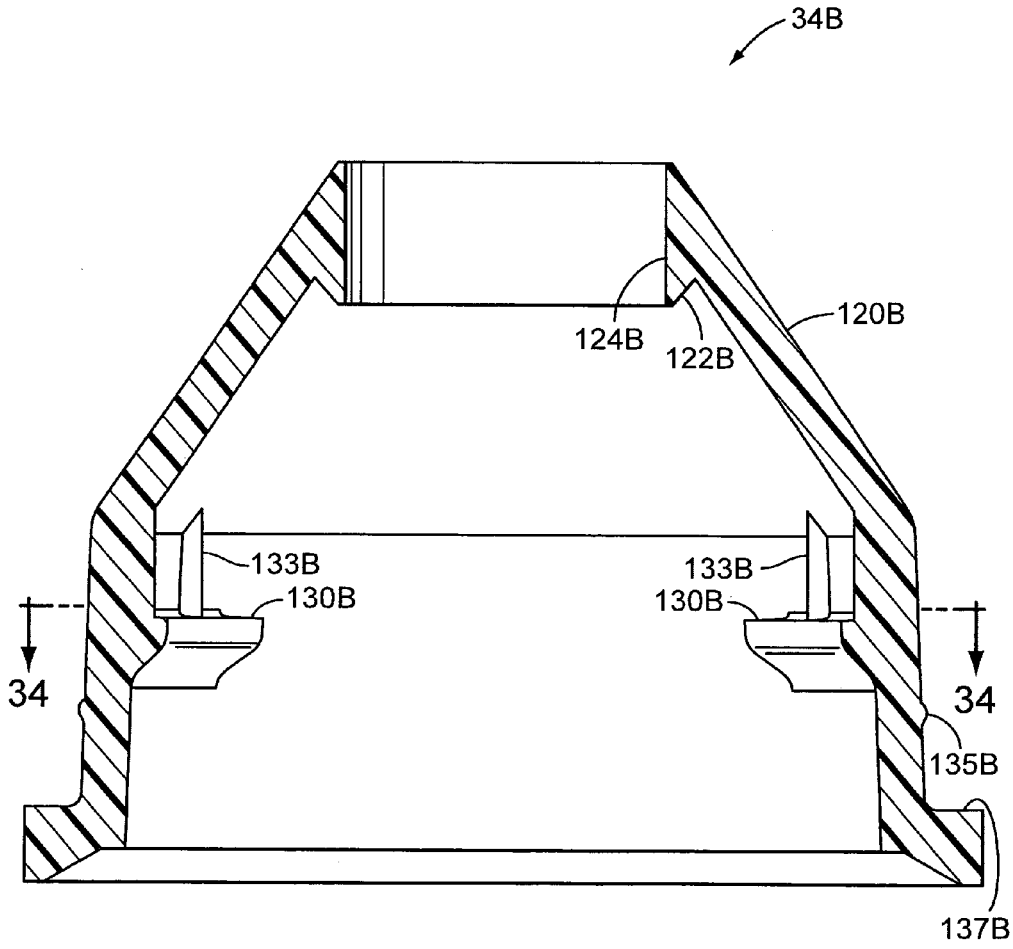
FIG. 33 is a cross-sectional view of the clamp member taken generally along the plane 33-33 in FIG. 32.
Figure 34:
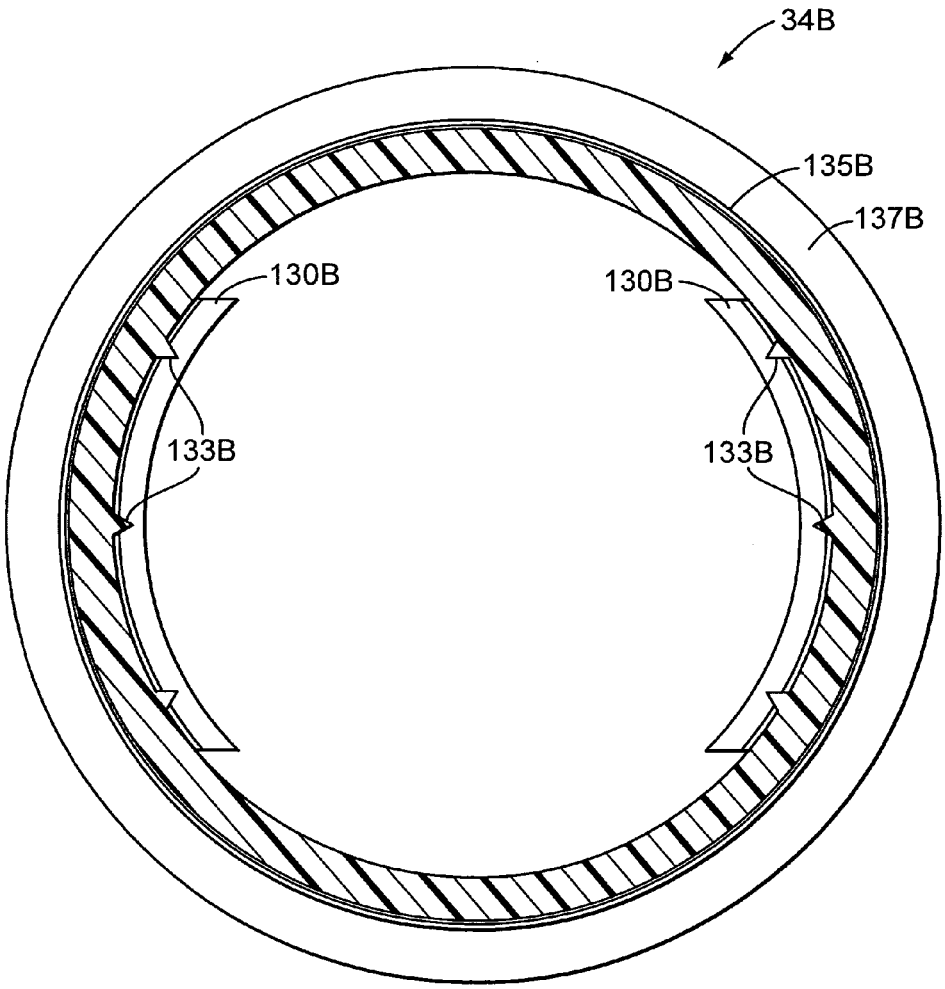
FIG. 34 is a cross-sectional view of the clamp member taken generally along the plane 34-34 in FIG. 33.
Figure 35:
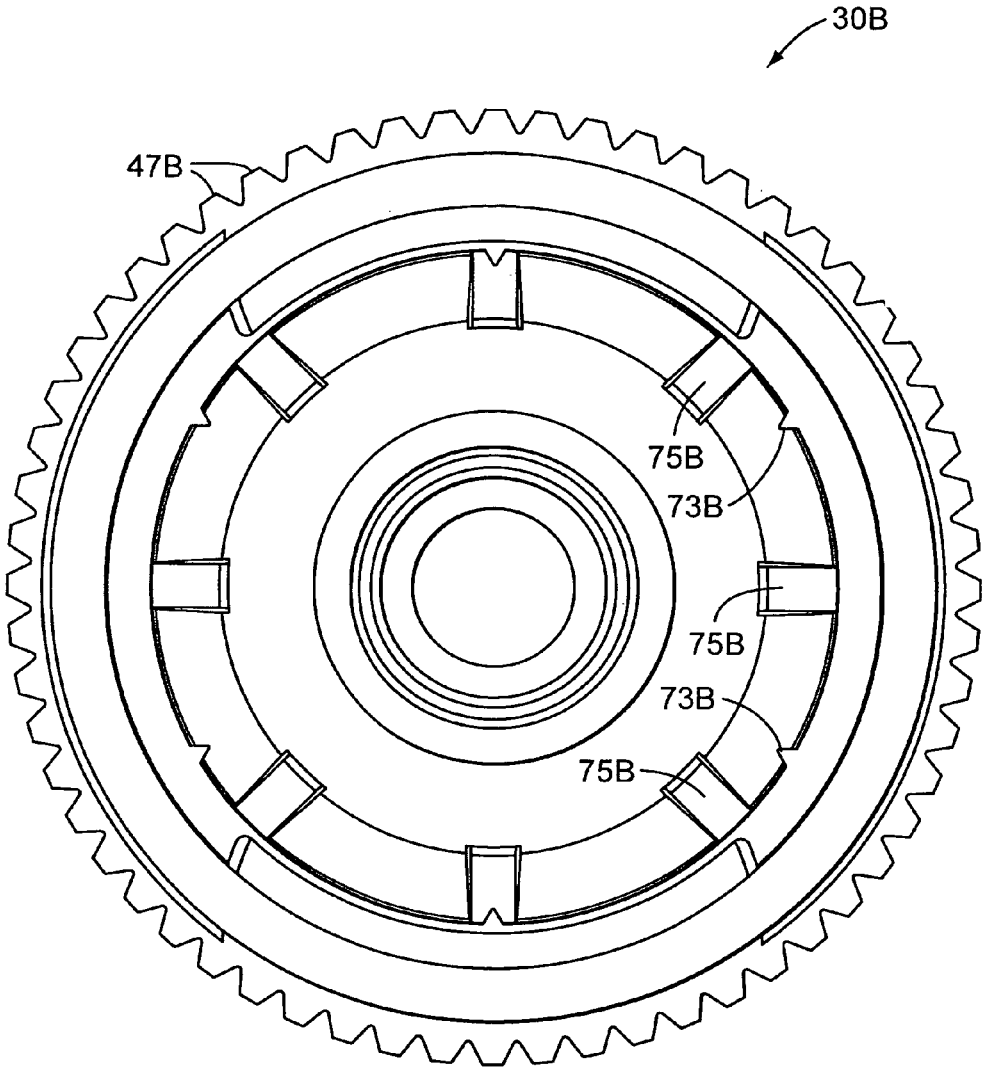
FIG. 35 is a bottom plan view of the closure body shown in FIG. 22.
Figure 36:
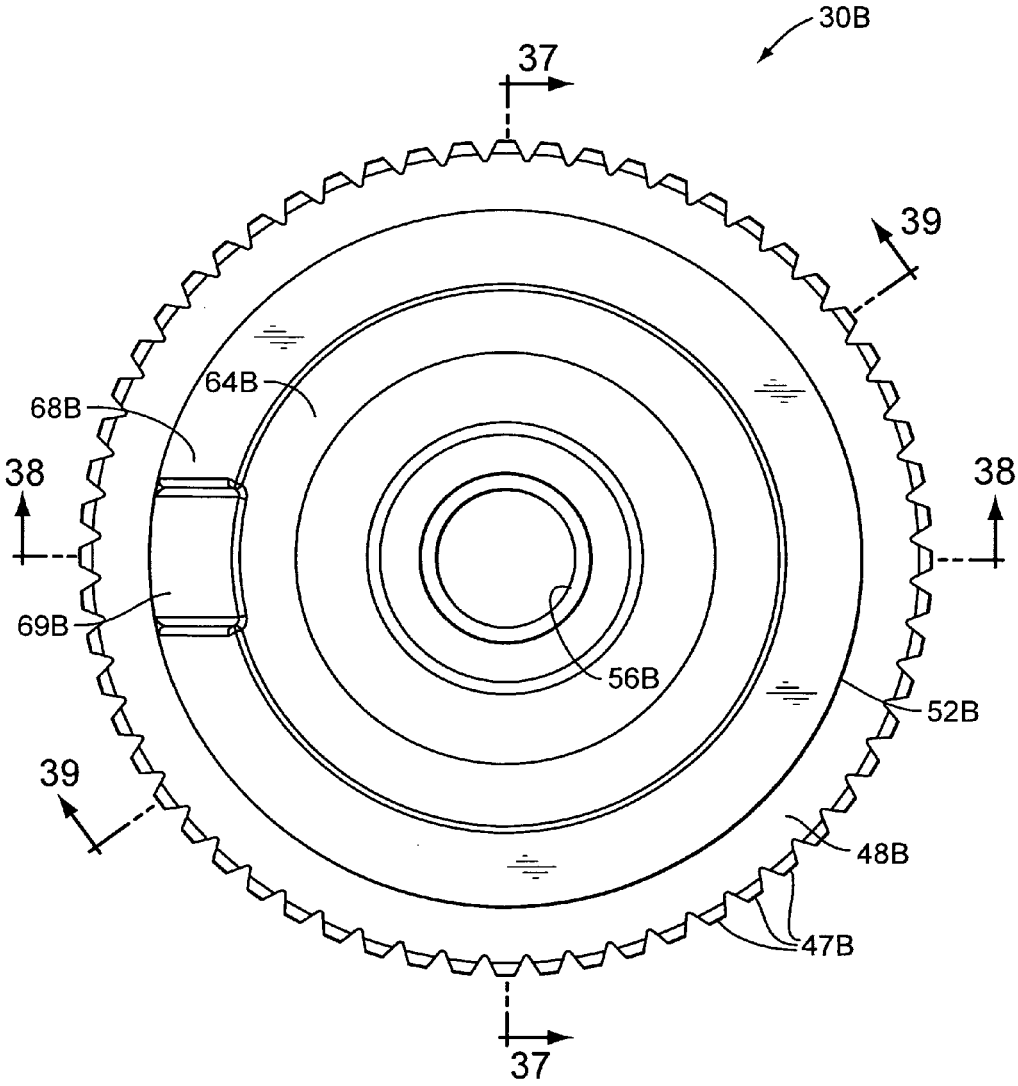
FIG. 36 is a top plan view of the third embodiment closure body illustrated in FIG. 35.

As can be seen in FIGS. 32-34, the clamp member 34B preferably has a frustoconical portion 120B and a lower cylindrical wall 121B. At the upper end of the frustoconical portion 120B, the clamp member 34 extends radially laterally inwardly toward the valve 32B to define an annular, distal lip or retention lip 122B (FIG. 33). The retention lip 122B defines an aperture 124B through which the valve 32B projects as can be seen in FIG. 2. As can be seen in FIG. 28, the clamp member annular, retention lip 122B is received in the valve skirt annular groove 88B to retain the valve skirt 80B around the body support column 54B so that the valve skirt interior surface 82B sealingly engages the exterior surface 60B of the support column 54B.

The clamp member 34B includes at least one, and preferably two, retention flanges 130B (FIGS. 32, 33, and 34) which extend radially inwardly. When the body 30B, valve 32B, and clamp member 34B are assembled as shown in FIG. 44, each clamp member flange 130B extends under the body teeth or serrations 47B so that the retention flange 130B is engaged with the bottom ends of the closure body teeth 47B.

As can be seen in FIGS. 29, 33 and 34, the clamp member 34B also has radially inwardly projecting splines or teeth 133B which engage the closure body anti-rotation teeth 47B (as shown in FIG. 29) to prevent relative rotation between the clamp member 34B and body 30B.

The clamp member 34B cylindrical wall 121B includes a radially outwardly projecting snap-fit retention bead 135B (FIGS. 21 and 23) for cooperating with the overcap 36B. The clamp member 34B also includes a radially outwardly projecting bottom flange 137B.

To initially assemble the closure components, the valve 32B is first disposed on the support column 54B of the closure body 30B, and then the clamp member 34B is pushed down over the valve 32B until the clamp member lip 122B is received in the valve annular groove 88B as shown in FIGS. 43 and 44. The valve 32B is sufficiently resilient and can temporarily deform so as to accommodate the proper seating of the clamp member lip 122B in the valve annular groove 88B. As the clamp member 34B is pushed downwardly over the valve 32B, the body support column 54B inside the valve 32B maintains the valve 32B in position and prevents collapse of the valve base or skirt 80B.

As the clamp member 34B is pushed down over the valve 32B, the underside of each clamp member flange 130B engages the body base annular shoulder or frustoconical surface 48B (i.e., lead-in surface) and slides downwardly along it. As the clamp member 34B is pushed downwardly with sufficient force, the clamp member flanges 130B expand or spread apart laterally outwardly (temporarily and elastically) so that the flanges 130B first move along the frustoconical surface 48B of the body base 40B to the bottom edge (i.e., outer edge) of the teeth 47B at the lower end of the frustoconical surface 48B and then move vertically downwardly along the teeth 47B so that the flanges 130B can snap under the bottoms of the closure body teeth 47B (FIG. 44) owing to the inherent resiliency of the material from which the clamp member 34B is made (e.g., polypropylene in a presently preferred embodiment). The sealing of the valve interior surface 82B against the body surface 60B (FIG. 44) is effected through a combination of longitudinally and laterally directed force components, and this is very effective in providing proper sealing, and this arrangement accommodates ease of assembly.

After assembly, the clamp member 34B cannot rotate relative to the closure body 30B because the clamp member splines 133B engage the closure body teeth 47B. Compared to the first and second embodiments illustrated in FIGS. 18-44 (wherein the clamp member flanges 130 must be oriented in registry with the closure body slots 50), third embodiment clamp member splines 133B and closure body teeth 47B eliminates any necessity for rotationally orienting the clamp member 34B and closure body 30B during assembly.

When the clamp member flanges 130B are snapped in under the bottom edges of the closure body teeth 47B (FIG. 44), the clamp member 34B functions to maintain the lower portion of the valve skirt 80B (including the flange 86B) in compression against the closure body support column 54B, and preferably also against the closure body upwardly facing shoulder 64B (FIG. 44). This arrangement locks together the three components (i.e., the valve 32B, the body 30B, and the clamp member 34B) in the desired assembled relationship with the appropriate sealing surfaces tightly engaged.

The angle of the large frustoconical exterior surface of the frustoconical portion 120B of the clamp member 34B is preferably designed to generally match the angle of the head 90B of the valve 32B (see FIGS. 44 and 18) so that the closure 20B (after removal of any overcap 36B) appears to the user to have a sleek, generally smooth, tapering or narrowing configuration which assists in helping the user aim the dispensing product to a desired target region. The overall tapering design of the dispensing system provides or enhances the capability to more easily direct the discharge of the product being dispensed from the dispensing system 20B. The generally smooth, clean, tapering configuration is also relatively easy to keep clean.

Figure 25:
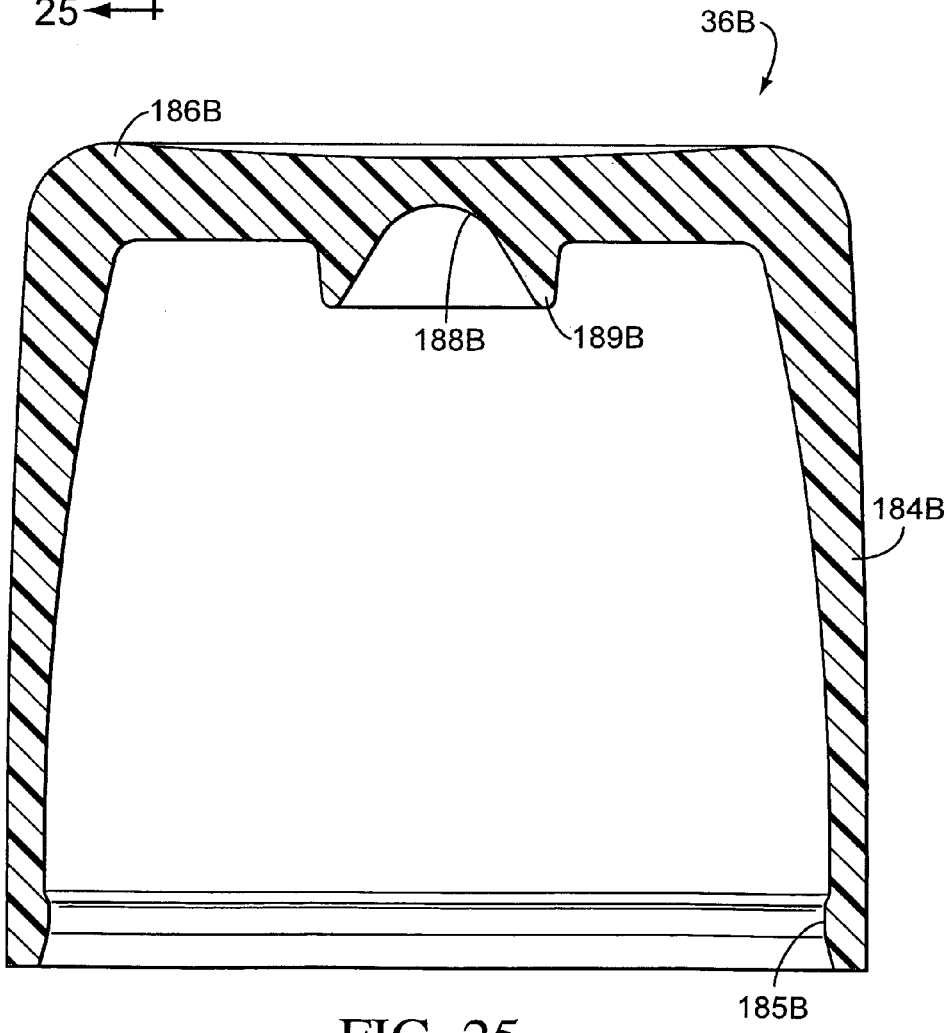
FIG. 25 is a cross-sectional view taken generally along the plane 25-25 in FIG. 24.
Figure 26:
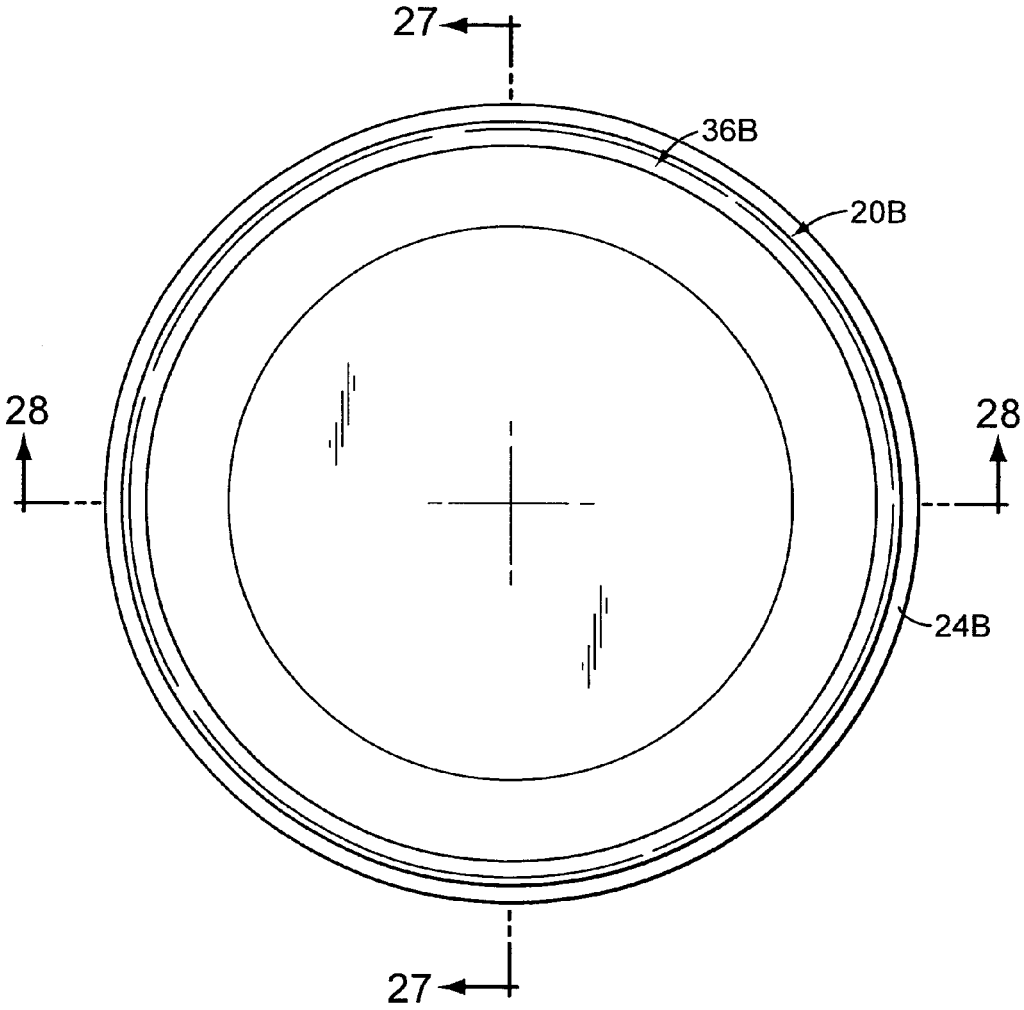
FIG. 26 is a top plan view of the third embodiment of the dispensing closure on the container with the overcap installed as shown in FIG. 27.

In the preferred third embodiment illustrated in FIGS. 18-44, the overcap 36B is adapted to be engaged in a snap-fit relationship with the closure body 30B. The overcap 36B has a skirt 184B (FIG. 25) and a top portion 186B (FIG. 25). An internal bead 185B is provided in the lower portion of the inside surface of the overcap skirt 184B (FIG. 25) to snap over, and engage, the clamp member bead 135B as shown in FIG. 44.

The overcap top portion 186B is preferably provided with a downwardly open, arcuate surface 188B (FIG. 25) in a flange 189B for covering the outer, distal end surface of the tip portion of the valve head 90B (as shown in FIG. 44) when the overcap 36B is installed. The close fitting relationship between the overcap surface 188B and the valve head 90B serves to prevent unintended opening of the valve 32B during shipping, storage, and handling if the container 22B is accidentally subjected to impact forces of a magnitude that would be sufficient to cause opening of the valve 32B in the absence of the overcap.

The assembly of the overcap 36B, valve 32B, clamp member 34B, and body 30B can next be mounted to the container 22B as shown in FIGS. 27 and 28. To this end, the assembly is pushed down over the container neck 26B until the inwardly facing sides of the closure body base flanges 46B ride over the container neck flange 25B. The closure body base flanges 46B and wall 44B temporarily and elastically deflect radially outwardly until the top surface of the flanges 46B reach the bottom of the container neck flange 25B and then return to the undeflected position under the container neck flange 25B (FIG. 28). The abutment ribs 75B inside the closure body 30B limit the downward movement of the closure body 30B.

As can be seen in FIGS. 27 and 28, the bottom of the overcap skirt 184B can be pushed down on the clamp member flange 137B during installation of the dispensing assembly (i.e., the assembly of the overcap 36B, valve 32B, clamp member 34B, and body 30B) on the container neck 26B. As can be seen in FIGS. 28 and 29, after the dispensing assembly is installed, the engagement of the closure body teeth or ribs 73B with the container neck teeth 27B prevents relative rotation between the dispensing assembly and the container.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing system for a container that has an opening to the container interior where a product may be stored, said dispensing system comprising:

(A) a body for extending from said container at said opening, said body including (1) a base for being mounted to, and extending from, said container, (2) a support column projecting outwardly from said base, and (3) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface engaging said body support column, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, and (2) a retention flange that is engaged with said body to prevent said clamp member from moving outwardly relative to said body and valve;

wherein said body defines at least one slot and an angled lead-in surface adjacent said at least one slot for being temporarily engaged by said at least one retention flange as said clamp member is being mounted on said body whereby said retention flange moves along said lead-in surface.

2. A dispensing system for a container that has an opening to the container interior where a product may be stored, said dispensing system comprising:

(A) a body for extending from said container at said opening, said body including (1) a base for being mounted to, and extending from, said container, (2) a support column projecting outwardly from said base, and (3) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface engaging said body support column, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, and (2) a retention flange that is engaged with said body to prevent said clamp member from moving outwardly relative to said body and valve;

wherein said body has a peripheral collar that is located radially beyond said base and that has an upper end defining a frustoconical surface; and said clamp member has a lower end terminating in a peripheral margin defining a frustoconical surface for mating with said body peripheral collar frustoconical surface.

3. A dispensing system for a container that has an opening to the container interior where a product may be stored, said dispensing system comprising:

(A) a body for extending from said container at said opening, said body including (1) a base for being mounted to, and extending from, said container, (2) a support column projecting outwardly from said base, and (3) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface engaging said body support column, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, and (2) a retention flange that is engaged with said body to prevent said clamp member from moving outwardly relative to said body and valve;

wherein said body has a peripheral collar that has at least one external male thread segment.

4. The system in accordance with claim 3 in which said system further includes a removable overcap defining a skirt with an internal female thread segment engaged with said body peripheral collar external male thread segment.

5. A dispensing system for a container that has an opening to the container interior where a product may be stored, said dispensing system comprising:

(A) a body for extending from said container at said opening, said body including (1) a base for being mounted to, and extending from, said container, (2) a support column projecting outwardly from said base, and (3) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface engaging said body support column, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, and (2) a retention flange that is engaged with said body to prevent said clamp member from moving outwardly relative to said body and valve;

wherein said body has a peripheral collar that defines an annular flat shoulder at the top of said body peripheral collar; and said system further includes an overcap hingedly attached to said body for moving between (1) a closed position on top of said body peripheral collar annular flat shoulder to cover said valve, and (2) an open position in which said valve is exposed.

6. A dispensing system for a container that has an opening to the container interior where a product may be stored, said dispensing system comprising:

(A) a body for extending from said container at said opening, said body including (1) a base for being mounted to, and extending from, said container, (2) a support column projecting outwardly from said base, and (3) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface engaging said body support column, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, and (2) a retention flange that is engaged with said body to prevent said clamp member from moving outwardly relative to said body and valve;

wherein said body defines two slots;

said clamp member has at least one leg extending through at least one of said slots;

said retention flange extends from an end of at least one of said legs; and said body includes a peripheral collar joined to said base by two spaced-apart bridges so that each bridge is located between said two slots.

7. A dispensing system for a container that has an opening to the container interior where a product may be stored, said dispensing system comprising:

(A) a body for extending from said container at said opening, said body including (1) a base for being mounted to, and extending from, said container, (2) a support column projecting outwardly from said base, and (3) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface engaging said body support column, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, and (2) a retention flange that is engaged with said body to prevent said clamp member from moving outwardly relative to said body and valve;

wherein the system is for use with a container having a neck with a circumferential array of radially outwardly directed teeth and in which said body includes at least one radially inwardly directed rib for engaging the container neck teeth.

8. A dispensing system for a container that has an opening to the container interior where a product may be stored, said dispensing system comprising:

(A) a body for extending from said container at said opening, said body including (1) a base for being mounted to, and extending from, said container, (2) a support column projecting outwardly from said base, and (3) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface engaging said body support column, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, and (2) a retention flange that is engaged with said body to prevent said clamp member from moving outwardly relative to said body and valve;

wherein said body includes a circumferential array of radially outwardly directed teeth; and said clamp member includes at least one radially inwardly directed spline for engaging said radially outwardly directed teeth of said body.

9. A dispensing system for a container that has an opening to the container interior where a product may be stored, said dispensing system comprising:

(A) a body for extending from said container at said opening, said body including (1) a base for extending from said container, (2) at least one slot defined in said body, (3) a support column projecting outwardly from said base and defining a frustoconical surface, and (4) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface having a frustoconical configuration for engaging said body support column frustoconical surface, and (b) a peripheral annular groove which is open laterally, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is received in said valve skirt annular groove to retain said valve skirt around said body support column, (2) at least one leg extending through said at least one slot of said body, and (3) a retention flange that (a) extends from said at least one leg of said clamp member, and (b) is engaged with said body to prevent said clamp member from moving outwardly relative to said body and valve.

10. A dispensing system for a container that has (1) an opening to the container interior where a product may be stored, (2) a circumferential array of radially outwardly directed teeth, and (3) a radially extending, annular flange, said dispensing system comprising:

(A) a body for extending from said container at said opening, said body including (1) a base for extending from said container, (2) at least one radially inwardly directed rib for engaging the container neck teeth, (3) at least one radially inwardly directed flange for establishing a snap fit engagement with said container flange to hold said body to said container, (4) a circumferential array of radially outwardly extending teeth, (5) a support column projecting outwardly from said base and defining a frustoconical surface, and (6) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface having a frustoconical configuration for engaging said body support column frustoconical surface, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, (2) at least one radially inwardly directed spline for engaging said radially outwardly directed teeth of said body, and (3) at least one radially inwardly directed retention flange for engaging under said radially outwardly directed teeth of said body to prevent said clamp member from moving away from said body and valve.

11. A dispensing system for a container that has (1) an opening to the container interior where a product may be stored, and (2) a radially extending, annular flange, said dispensing system comprising:

(A) a body for extending from said container at said opening, said body including (1) a base for extending from said container, (2) at least one radially inwardly directed flange for establishing a snap fit engagement with said container flange to hold said body to said container, (3) a circumferential array of radially outwardly extending teeth, (5) a support column projecting outwardly from said base and defining a support surface, and (6) a product discharge passage through said base and support column;

(B) a dispensing valve that comprises flexible, resilient material defining (a) a mounting skirt disposed around said body support column, and (b) an outwardly extending, narrowing dispensing head, said valve mounting skirt defining (a) an interior sealing surface having a configuration for engaging said body support column support surface, and (b) an annular shoulder, said valve head defining a normally closed dispensing orifice which opens to permit flow therethrough in response to a pressure differential across said valve; and (C) a clamp member surrounding at least a portion of said valve skirt, said clamp member having (1) a retention lip that (a) defines an aperture through which said valve head projects, and (b) is engaged with said valve skirt annular shoulder to retain said valve skirt around said body support column, (2) at least one radially inwardly directed spline for engaging said radially outwardly directed teeth of said body, and (3) at least one radially inwardly directed retention flange for engaging under said radially outwardly directed teeth of said body to prevent said clamp member from moving away from said body and valve.

* * * * *